US012631096B2

(12) United States Patent
de Almeida et al.

(10) Patent No.: US 12,631,096 B2
(45) Date of Patent: May 19, 2026

(54) SUBSEA PUMPING AND BOOSTER SYSTEM

(71) Applicant: Baker Hughes Energy Technology UK Limited, Bristol (GB)

(72) Inventors: Rômulo M. de Almeida, Rio de Janeiro (BR); Leonardo Cardoso, São Paulo (BR); Daniel Gruenbaum Lemos, Rio de Janeiro (BR); Leonardo Pacheco, Rio de Janeiro (BR); Marcio Povea, São Paulo (BR)

(73) Assignee: Baker Hughes Energy Technology UK Limited, Bristol (GB)

( * ) Notice: Subject to any disclaimer, the term of this patent is extended or adjusted under 35 U.S.C. 154(b) by 175 days.

(21) Appl. No.: 17/692,590

(22) Filed: Mar. 11, 2022

(65) Prior Publication Data

US 2022/0290538 A1 Sep. 15, 2022

Related U.S. Application Data

(60) Provisional application No. 63/161,248, filed on Mar. 15, 2021.

(51) Int. Cl.
*E21B 43/12* (2006.01)
*E21B 33/038* (2006.01)
(Continued)

(52) U.S. Cl.
CPC ..... *E21B 43/128* (2013.01); *E21B 33/038* (2013.01); *E21B 43/01* (2013.01);
(Continued)

(58) Field of Classification Search
CPC ..... E21B 43/128; E21B 43/01; E21B 43/013; E21B 33/038; F04D 13/08; F04D 13/10; F04D 15/0072
(Continued)

(56) References Cited

U.S. PATENT DOCUMENTS 4,194,857 A * 3/1980 Chateau ..... E21B 43/017 405/203
4,405,016 A * 9/1983 Best ..... E21B 43/013 166/347
(Continued)

FOREIGN PATENT DOCUMENTS

WO 2015/199546 12/2015
WO WO-2015199546 A1 * 12/2015 ..... E21B 34/066

OTHER PUBLICATIONS

International Search Report and Written Opinion mailed Jun. 28, 2022 in corresponding PCT Application No. PCT/EP2022/025105.

*Primary Examiner* — Tara Schimpf
*Assistant Examiner* — Patrick F Lambe
(74) *Attorney, Agent, or Firm* — Hogan Lovells US LLP

(57) ABSTRACT

A system includes a pumping unit and a base unit. The pumping unit includes a plurality of tubulars and two or more electric submersible pumps (ESPs). The pumping unit further includes a plurality of valves associated with the plurality of tubulars, the plurality of valves each independently moveable between respective open positions and closed positions, wherein respective positions of groups of valves corresponding to operational configurations selected to adjust operation of the two or more ESPs. The base unit is adapted to receive the pumping unit and includes a subsea connector for receiving a production line and directing production fluid toward the pumping unit. The base unit also includes an isolation valve.

20 Claims, 19 Drawing Sheets

(51) Int. Cl.

| | |
|---|---|
| ***E21B 43/01*** | (2006.01) |
| ***E21B 43/013*** | (2006.01) |
| ***F04D 13/08*** | (2006.01) |
| ***F04D 13/10*** | (2006.01) |
| ***F04D 15/00*** | (2006.01) |

(52) U.S. Cl.
CPC ..... *E21B 43/013* (2013.01); *F04D 13/08* (2013.01); *F04D 13/10* (2013.01); *F04D 15/0072* (2013.01)

(58) Field of Classification Search
USPC ..... 166/352
See application file for complete search history.

(56) References Cited

U.S. PATENT DOCUMENTS

| | | | | |
|---|---|---|---|---|
| 7,314,084 | B2 | 1/2008 | Rodrigues | |
| 7,516,795 | B2 * | 4/2009 | Lopes Euphemio | E21B 43/121 166/368 |
| 8,511,386 | B2 | 8/2013 | Rodrigues | |
| 2003/0180096 | A1 * | 9/2003 | Appleford | E21B 41/08 166/345 |
| 2011/0056699 | A1 * | 3/2011 | Bjoroy | F04B 23/04 166/369 |
| 2013/0019969 | A1 * | 1/2013 | Scarsdale | F04D 13/086 137/565.01 |

* cited by examiner

SUBSEA PUMPING AND BOOSTER SYSTEM

CROSS-REFERENCE TO RELATED APPLICATIONS

This application claims priority to and the benefit of U.S. Provisional Patent Application No. 63/161,248, filed Mar. 15, 2021 and titled "SUBSEA PUMPING AND BOOSTER SYSTEM," the full disclosure of which is hereby incorporated in its entirety for all purposes.

BACKGROUND

1. Field of the Disclosure

The present disclosure relates to pumping systems. Specifically, the present disclosure relates to systems and methods for subsea pumping and boosting to increase oil and gas production.

2. Description of Related Art

Throughout the life of an oil and gas producing well or during initial production operations, formation pressures or recovery rates may drop or be less than desirable, which often leads to expensive and time consuming well intervention techniques. These techniques may include mechanical techniques, such as adding boosters or pumps into the wellbore, or chemical techniques to stimulate additional flow. However, these techniques may not be suitable for all wells, for example, where some reservoirs may provide a fluid composition that is richer in light hydrocarbons and carbon dioxide ($CO_2$), which generate large volumes of gas as pressure drops along the fluid transportation system. These scenarios may be even more challenging with offshore wells, which may factor in water production as well as operating in more extreme pressure and temperature scenarios.

SUMMARY

Applicant recognized the problems noted herein and conceived and developed embodiments of systems and methods, according to the present disclosure, for subsea pumping and boosting systems.

In an embodiment, a system includes a pumping unit and a base unit. The pumping unit includes a plurality of tubulars, the plurality of tubulars directing flow from a first end to a second end. The pumping unit also includes two or more electric submersible pumps (ESP) positioned within at least two or more tubulars of the plurality of tubulars, the two or more ESPs receiving production fluid and increasing a pressure of the production fluid. The pumping unit further includes a plurality of valves associated with the plurality of tubulars, the plurality of valves each independently moveable between respective open positions and closed positions, wherein respective positions of groups of valves corresponding to operational configurations selected to adjust operation of the two or more ESPs. The base unit is adapted to receive the pumping unit, the base unit being positioned at a subsea location to support the pumping unit, and includes a subsea connector, arranged in a horizontal configuration, for receiving a production line and directing production fluid toward the pumping unit. The base unit also includes an isolation valve, upstream of the subsea connector, to block production fluid.

In an embodiment, a system includes a pumping unit with a plurality of tubulars, the plurality of tubulars directing flow from a first end to a second end, two or more electric submersible pumps (ESPs) positioned within at least two or more tubulars of the plurality of tubulars, the two or more ESPs receiving production fluid and increasing a pressure of the production fluid, and a plurality of valves associated with the plurality of tubulars, the plurality of valves each independently moveable between respective open positions and closed positions, wherein respective positions of groups of valves correspond to operational configurations selected to adjust operation of the two or more ESPs. The system also includes a base unit, adapted to receive the pumping unit, the base unit being positioned at a subsea location to support the pumping unit, where the base unit includes a subsea connector for receiving a production line and directing production fluid toward the pumping unit and an isolation valve, upstream of the subsea connector, to block production fluid.

In an embodiment, a system includes a pumping unit with a plurality of tubulars, the plurality of tubulars directing flow from a first end to a second end, two or more electric submersible pumps (ESPs) positioned within at least one tubular of the plurality of tubulars, the two or more ESPs receiving fluid and increasing a pressure of the fluid, and a plurality of valves associated with the plurality of tubulars, the plurality of valves each independently moveable between respective open positions and closed positions, wherein a plurality of valve configurations correspond to a plurality of operational modes for the two or more ESPs. The system also includes a base unit, adapted to receive the pumping unit. The base unit includes a connector for receiving a fluid line and an isolation valve, upstream of the connector.

BRIEF DESCRIPTION OF DRAWINGS

The present technology will be better understood on reading the following detailed description of non-limiting embodiments thereof, and on examining the accompanying drawings, in which.

DETAILED DESCRIPTION

Figure 1:
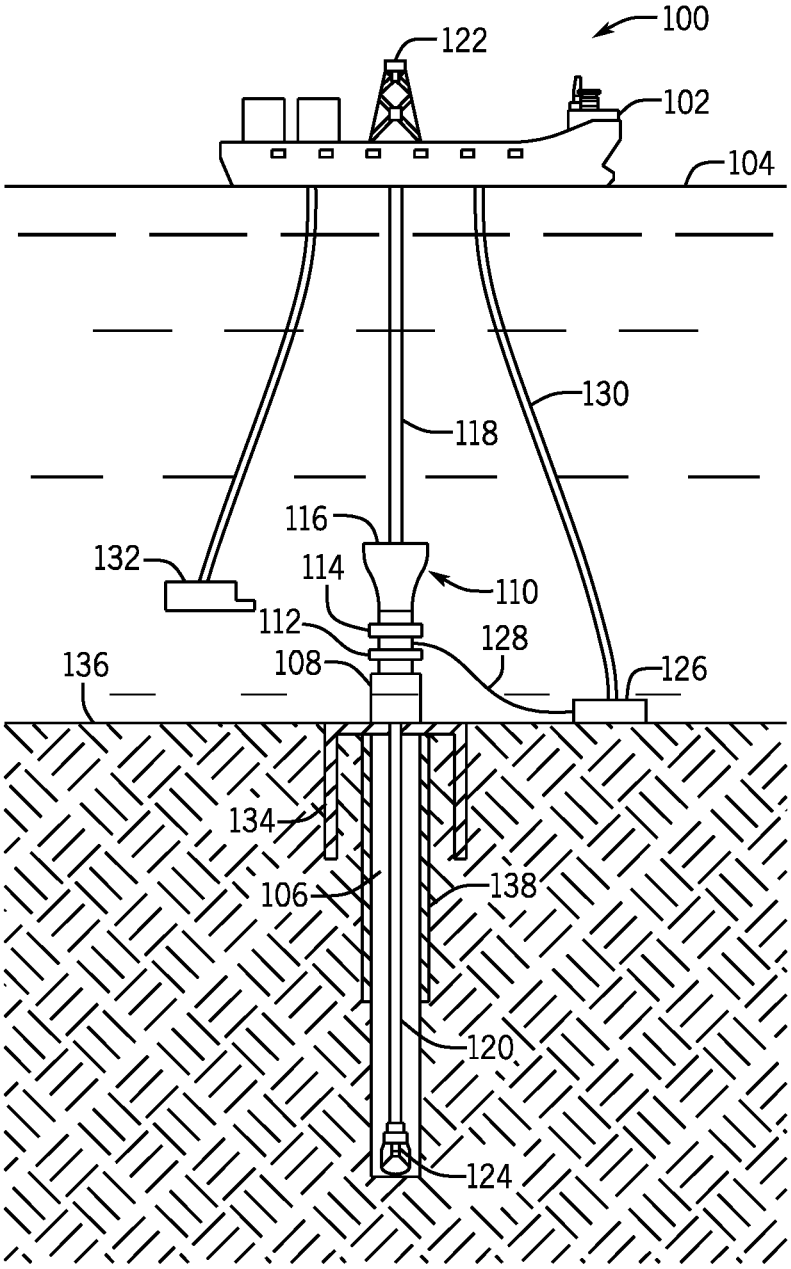
FIG. 1 is a schematic side view of an embodiment of an offshore drilling operation, in accordance with embodiments of the present disclosure.

The foregoing aspects, features, and advantages of the present disclosure will be further appreciated when considered with reference to the following description of embodiments and accompanying drawings. In describing the embodiments of the disclosure illustrated in the appended drawings, specific terminology will be used for the sake of clarity. However, the disclosure is not intended to be limited to the specific terms used, and it is to be understood that each specific term includes equivalents that operate in a similar manner to accomplish a similar purpose.

When introducing elements of various embodiments of the present disclosure, the articles "a", "an", "the", and "said" are intended to mean that there are one or more of the elements. The terms "comprising", "including", and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments", or "other embodiments" of the present disclosure are not intended to be interpreted as excluding the existence of additional embodiments that also incorporate the recited features. Furthermore, reference to terms such as "above", "below", "upper", "lower", "side", "front", "back", or other terms regarding orientation or direction are made with reference to the illustrated embodiments and are not intended to be limiting or exclude other orientations or directions. It should also be appreciated that dimensions, angles, and other components may be referred to as being substantially within a range of approximately plus or minus 10 percent.

Embodiments of the present disclosure are directed toward systems and methods for boosting or increasing a pressure in an underground formation. Embodiments may be utilized in a subsea environment, but it should be appreciated that other environments may also be used. Various embodiments include one or more pumps, which may be submersible pumps, to increase a pressure within the formation. These pumps may be part of a modular systems that includes one or more removable pumping units and one or more base units. The pumping units may include features to facilitate coupling to the base units and the base units may include one or more connections to couple to associated equipment, such as production trees. In various embodiments, specific valve configurations may determine different operational modes of the pumps, which may include, but are not limited to, series operation, parallel operation, re-circulating, standby, and bypass. Furthermore, embodiments may enable multiple banks of pumping units to be coupled together in a variety of different configurations. Accordingly, systems and methods may enable well production and pressure stimulation without intervention into the wellbore itself by providing an external, skid-mounted, retrievable pumping system.

In one or more embodiments, systems and methods of the present disclosure may be utilized in order to enhance recovery and/or provide fluids for boosting production. That is, an inlet of the system may receive a fluid and then increase the pressure of the fluid to transport the fluid to another location. Additionally, in embodiments, the inlet of the system may receive a fluid for injection or use with a wellbore. Accordingly, systems and methods of the present disclosure may be described with reference to well intervention or production recovery, but such descriptions are for illustrative purposes only and are not intended to limit the scope of the present disclosure. In one or more embodiments, fluids utilized with the system may include hydrocarbons, water, solids-laden fluids, muds, and the like. Accordingly, various embodiments may be used with a variety of operations. Furthermore, it should be appreciated that subsea operations are also described by way of example, and other configurations and uses may be suitable for systems of the present disclosure. For example, embodiments may include surface-mounted systems that send and/or receive fluids from offshore facilities or other surface facilities. Furthermore, embodiments may include rig-mounted or ship-mounted systems that are utilized with subsea wells. Accordingly, systems and methods may be utilized to allow pump production fluid from well to subsea, well to topside, well to shore, well to well, topside to well, topside to subsea and topside to shore, among various other configurations.

Various embodiments of the present disclosure provide a system for increasing oil and gas production flow. In at least one embodiment, an electrical submersible pump (ESP) is utilized in a skid-mounted pumping module positioned external to a wellbore. In at least one embodiment, the ESP may be arranged at mudline, associated with a manifold, or any other reasonable subsea location. The ESP may then be used to increase pressure and/or flow with a wellbore, reducing the impacts of low reservoir pressures, flow drop in various flow lines, or other potential elements that may impact flow and recovery rates. As will be appreciated, flow and pressure drop may be experienced in mature wells, wells where paraphine and other elements have reduced flow rates, or fields where pressure management has resulted in a decrease in formation pressures. Accordingly, systems and methods may be utilized without well intervention (e.g., adding equipment within the wellbore) to increase recovery rates, postpone various well intervention operations (e.g., mechanical and/or chemical), and reduce operating expenses.

Systems and methods are directed to overcome challenges and drawbacks with boosting or stimulating production with wellbores, and in various embodiments, may be particularly suited for subsea applications. Accordingly, systems and methods may be directed to increasing efficiency and reducing costs. Design limitations as gas fraction, pump serialization and pumps arrangement, directly affect production efficiencies. Prior art solutions do not provide a versatile design sufficient to overcome the problems currently faced in the industry. By way of example, U.S. Pat. No. 7,516,795 introduces a system that cannot function as a combination of single pump operations, pumps in series, and pumps in parallel without retrieving the system and installing a new configuration. Additionally, some reservoirs may provide a fluid composition that is richer in lighter hydrocarbons and $CO_2$ (carbon dioxide), for instance, generating large volumes of gas as pressure drops along fluid transportation systems (flowlines, risers, valves, etc.). Systems and methods now need capabilities to accommodate more than 60% of gas fraction in the production flow. However, U.S. Pat. No. 7,516,795 is limited up to 60%. Furthermore, methods directed toward building a dummy well in U.S. Pat. No. 7,314,084 do not overcome the problems, as this dummy well still has problems with accessibility and maintains a high cost for pump replacement and/or maintenance.

Systems and methods may be utilized in offshore recovery operations, which a platform or floating production, storage, and offloading vessel (FPSO) are utilized. As a result, such systems are operational to accommodate the inclusion of both gas and water, among other fluids, with oil production. In various embodiments, systems may include exportation flow paths for gas. In various embodiments, artificial lift technologies, such as ESPs, are utilized to increase hydrocarbon recovery. In at least one embodiment, a modular subsea system is utilized, which may include a base and a modular pumping system. The modular pumping system may include one or more artificial lift devices to increase the hydrocarbon production pressure to improve recovery rates and/or extend well life. Moreover, various systems and methods may reduce operating costs due to ease of access with the modular pumping system as opposed to well interventions, which may utilize additional equipment and take more time.

Embodiments of the pressure disclosure may also enable serialization, where different pumping modules may be coupled together, and in some embodiments, may utilize a common base. Furthermore, various embodiments may be a scalable solution that enables different installation configurations to vary an amount of boost provided. In at least one embodiment, systems and methods may include one or more ESPs, arranged in a horizontal position, positioned within one or more tubulars associated with the modular pumping unit. Additionally, mechanical connectors may be arranged at an inlet and an outlet, and in certain embodiments the connectors may also be positioned in a horizontal configuration. Furthermore, systems and methods may include a plurality of configurable valves to enable a variety of pumping configurations. In at least one embodiment, the valves may be positioned between open and closed positions to enable operation of the pumps in series or parallel. Additionally, the valves may be positioned between open and closed positions to enable operation of the pumps in a serialized manner, in a bypass configuration, or in a flushing configuration. The serialized connections may be enabled through one or more connections, for example at a top of the pumping unit, to receive an additional pumping unit. In at least one embodiment, controllers may be utilized to send and receive instructions for valve and/or pump operations, for example via a wired or wireless communication system. This communication system may enable start and stop of the pumping operations, changes in valve position, communication of operating parameters, and the like. Various embodiments may also include a base frame that receives the modular pumping unit, where the base frame includes flowline connections at the seabed for coupling to a wellbore. Furthermore, a modular skid frame may be incorporated for landing and to protect the base and/or pumping unit.

In one or more embodiments, the system may be referred to as a scalable modular smart pumping and boost system. Additionally, individual components may be referred to as a base portion and as a pumping unit. In at least one embodiment, a booster pump is utilized, which may be an ESP. The scalable smart pumping and boost system may additionally include an inlet manifold to promote a production flow bypass. In embodiments, the scalable modular smart pumping and boost system is capable of pumping the fluid production flow with gas volume fractions between 0% in minimum and 80% of gas volume fraction. Various embodiments may also include a heat exchange feature and/or injection points to heat fluid or chemicals inside the module to further alleviate blockages or plugging, for example due to hydrates or paraffin. Additionally, the system may include mechanical valves coupled in the retrievable module or in the fixed base frame accommodated in the seabed. Furthermore, the system may include isolation valves blocks coupled in the retrievable module or in the fixed base frame accommodated in the seabed.

FIG. 1 is a side schematic view of an embodiment of subsea drilling operation 100. The drilling operation includes a vessel 102 floating on a sea surface 104 substantially above a wellbore 106. A wellbore housing 108 sits at the top of the wellbore 106 and is connected to a blowout preventer (BOP) assembly 110, which may include shear rams 112, sealing rams 114, and/or an annular ram 116. One purpose of the BOP assembly 110 is to help control pressure in the wellbore 106. The BOP assembly 110 is connected to the vessel 102 by a riser 118. During drilling operations, a drill string 120 passes from a rig 122 on the vessel 102, through the riser 118, through the BOP assembly 110, through the wellhead housing 108, and into the wellbore 106. It should be appreciated that reference to the vessel 102 is for illustrative purposes only and that the vessel may be replaced with a floating platform or other structure. The lower end of the drill string 120 is attached to a drill bit 124 that extends the wellbore 106 as the drill string 120 turns. Additional features shown in FIG. 1 include a mud pump 126 with mud lines 128 connecting the mud pump 126 to the BOP assembly 110, and a mud return line 130 connecting the mud pump 126 to the vessel 102. A remotely operated vehicle (ROV) 132 can be used to make adjustments to, repair, or replace equipment as necessary. Although a BOP assembly 110 is shown in the figures, the wellhead housing 104 could be attached to other well equipment as well, including, for example, a tree, a spool, a manifold, or another valve or completion assembly.

One efficient way to start drilling a wellbore 106 is through use of a suction pile 134. Such a procedure is accomplished by attaching the wellhead housing 108 to the top of the suction pile 134 and lowering the suction pile 134 to a sea floor 136. As interior chambers in the suction pile 134 are evacuated, the suction pile 134 is driven into the sea floor 136, as shown in FIG. 1, until the suction pile 134 is substantially submerged in the sea floor 136 and the wellhead housing 108 is positioned at the sea floor 136 so that further drilling can commence. As the wellbore 106 is drilled, the walls of the wellbore are reinforced with concrete casings 138 that provide stability to the wellbore 106 and help to control pressure from the formation.

It should be appreciated that while FIG. 1 may describe a drilling environment, various embodiments may be directed toward well intervention and/or production systems. Furthermore, in various embodiments, systems and methods of the present disclosure may be applied to greenfield or new wells, for example in new wells with pressures that are less than desirable. Accordingly, while systems may be described with reference to well intervention, such disclosure is not intended to be limiting. As noted above, in various embodiments, formation pressures may decrease, which may often lead to expensive and time consuming well intervention to improve production recovery rates. In some situations, an ESP may be installed within the wellbore to increase pressures within the formation to facilitate recovery. However, installation of the pumps may be challenging and, if the pumps are lately accessed for maintenance or the like, it may be costly and difficult to obtain access. Embodiments of the present disclosure are directed toward systems and methods to provide external boosting systems that are easily accessible, if necessary, while providing sufficient pressure to enhance recovery operations.

Figure 2:
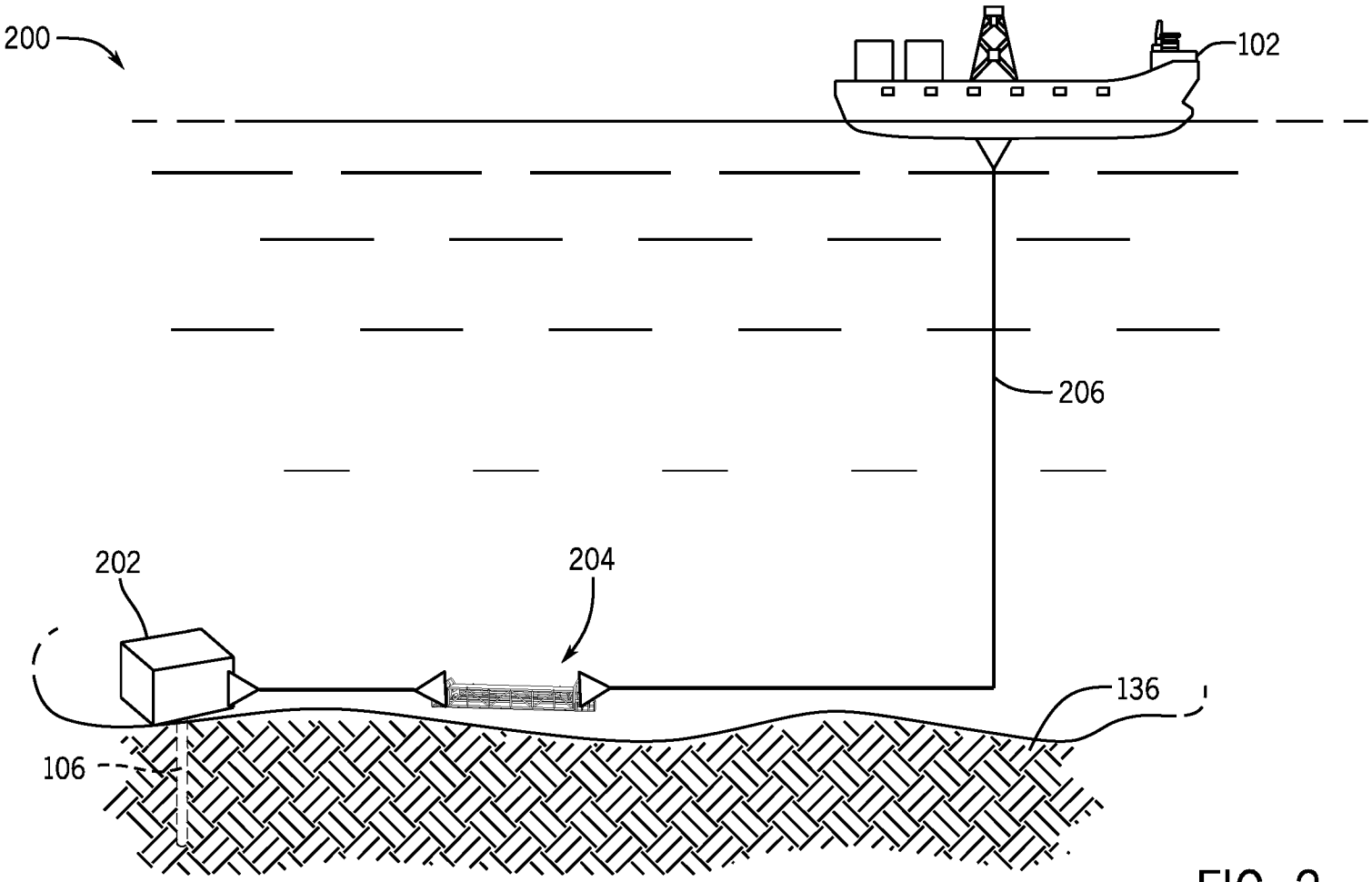
FIG. 2 is a schematic diagram of an embodiment of an offshore staging, in accordance with embodiments of the present disclosure.

FIG. 2 is a schematic diagram of an embodiment of a recovery staging 200 including the vessel 102, a subsea tree 202 (e.g., Christmas tree, XT, X-Tree), and a modular pumping system 204, in accordance with the present disclosure. In this example, a line 206, such as a flow line which may include sections of flexible or rigid piping, extends from the vessel 102 to the tree 202 via the modular pumping system 204. As will be described, the modular pumping system 204 may be arranged along the sea floor 136 and may include inlet and outlet connections to facilitate fluid connections between a variety of different components. In this example, the modular pumping system 204 may be landed on the sea floor 136 at an area proximate the tree 202 and then coupled to the tree 202 and the vessel 102, for example via flexible or rigid pipe or riser. Fluid may be directed into the wellbore 106 and/or recovered from the wellbore 106 and returned to the vessel 102.

Figure 3:
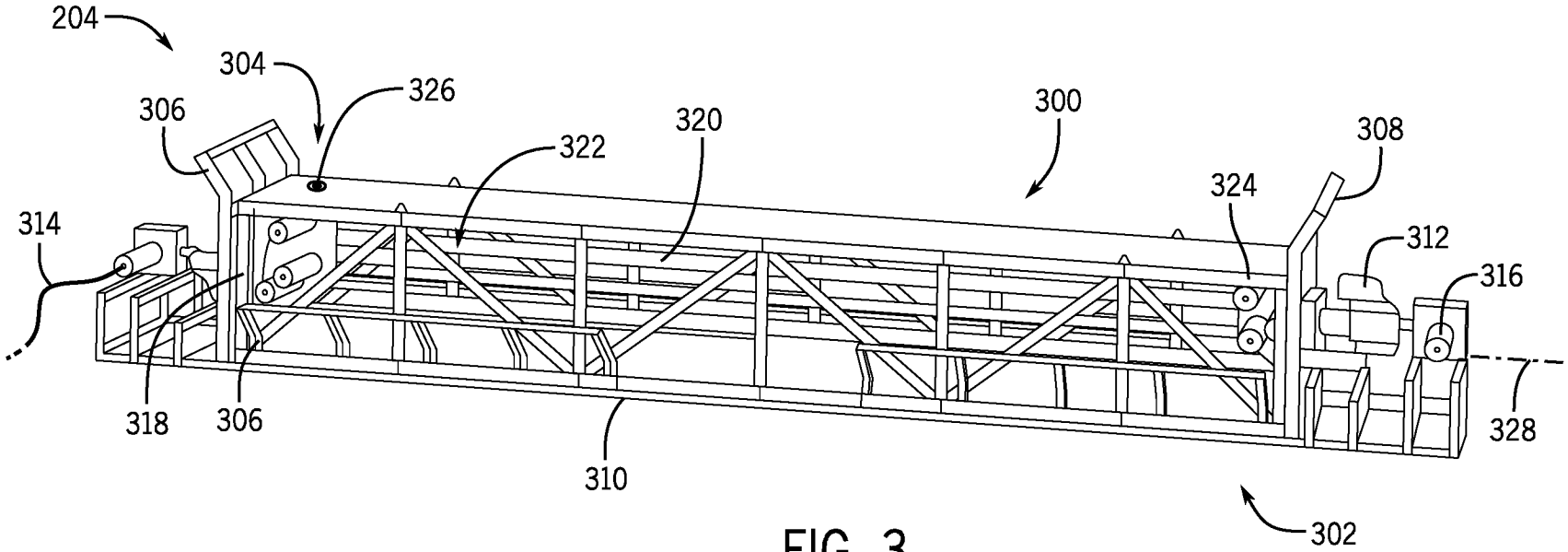
FIG. 3 is an isometric view of an embodiment of a modular pumping system, in accordance with embodiments of the present disclosure.

FIG. 3 is an isometric view of an embodiment of the modular pumping system 204. In this example, the modular pumping system 204 includes a pumping unit 300 (e.g., a pumping module) and a base unit 302. The base unit 302 is arranged to receive the pumping unit 300, which may be configured to engage a recess or receptacle 304 formed between posts 306 of the base unit 302. The receptacle 304 may include a base or floor that is axially lower than the surrounding posts 306, and as a result, at least a portion of the pumping unit 300 may be blocked from lateral movement due, at least in part, to the posts 306. That is, the posts 306 may define a space to receive the pumping unit 300 to block movement of the pumping unit 300 after installation. In various embodiments, the movement may be lateral movement (e.g., perpendicular to a longitudinal axis of the base unit 302) and/or elevational movement (e.g., parallel to a longitudinal axis of the base unit 302). Moreover, in this example, the posts 306 include a sloped upper end 308, which may facilitate installation of the pumping unit 300, for example, by guiding the pumping unit 300 toward the receptacle 304. As shown, the posts 306 has different sizes, where the side posts 306 are shorter than the front and back posts 306. It should be appreciated that this configuration and dimensionality is shown for illustrative purposes only and that the posts may be the same size, each post may be a different size, or any other combination thereof based on design considerations.

The base unit 302 includes a bottom portion 310 for supporting the base unit 302 on the sea floor. It should be appreciated that various reinforcement fittings and the like may be incorporated to accommodate the subsea environment. Further illustrated are subsea connectors 312, which in this example are arranged in a substantially horizontal configuration. Subsea connectors 312 may include mechanical, hydraulic, or other types of connections. It should be appreciated that this is for illustrative purposes only and that the subsea connectors 312 may be in a vertical configuration or at an angled configuration, among other options. As used herein, horizontal is with reference to an axis 328 extending along the base unit 302 (e.g., an axis parallel to the bottom portion 310). The subsea connectors 312 may be used to couple to production flow lines 314, such as the lines 206 shown in FIG. 2. As noted above, the production flow lines 314 may be rigid, flexible, or combinations thereof and may include mating connections to facilitate connection to the subsea connectors 312. Additionally, in one or more embodiments, isolation valves 316 may also be associated with the base unit 302. These isolation valves 316 may be arranged at inlets and outlets to block flow through the modular pumping system 204. Moreover, one or more valves (e.g., isolation valves) may be arranged at ends of the subsea connectors 312 between the production flow line 314 and the subsea connectors 312, which may provide additional isolation capabilities. That is, there may be pairs of isolation vales 316.

The illustrated pumping unit 300 includes a frame portion 318 and a plurality of tubulars 320, which may be pipe segments. The frame portion 318 may include a variety of beams, cross bars, posts, and the like in order to provide a structure frame for various components of the pumping unit 300, such as the tubulars 320. It should be appreciated that various aspects of the frame portion 318 may be particularly selected based on intended operating conditions, with longer pumping units 300 having more posts and cross bars, and shorter pumping units 300 have fewer. Furthermore, widths or thicknesses of the components may also vary based on expected operating conditions. The tubulars 320 may include electrical submersible pumps (ESPs) 322 for boosting a formation pressure. In one or more embodiments, the ESPs 322 may be arranged in a substantially horizontal configuration, however, this is by way of example only and the ESPs 322 may be in a vertical configuration and/or an angled configuration. Furthermore, ESPs 322 may not have the same configuration, for example a first ESP may be horizontal and a second ESP may be vertical. Accordingly, ESPs 322 may be at a variety of different angles and configurations. Additionally, in embodiments where there are multiple ESPs, it should be appreciated that each ESP may be operated independently, such that different ESPs may operate together or not at all during various stages of the operations. For example, one ESP may serve as a backup or provide redundancy to another. In operation, fluids may be directed toward the tubulars 320 and the ESPs 322 may add energy (e.g., pressure) to the fluid for injection into the wellbore. In this example, the pumping unit 300 includes a series of valves 324, which as will be described below, may be particularly configured to enable a variety of different operating modes for the pumping unit 300. By way of example, the valves may be moved between open and closed positions to enable parallel flow, series flow, re-circulating flow, and/or bypass flow. Furthermore, in one or more embodiments, serialization connectors 326 may be utilized to add additional pumping units 300, which may also be positioned on the base unit 302, or on a separate base unit 302.

In operation, one or more control signals may be utilized to adjust positions of the various valves 324 to begin a certain operating mode. Additional control signals may be used to adjust or otherwise change valve configurations. Furthermore, it should be appreciated that other control methods may be used, such as using ROVs to adjust valve positions without additional control signals. Moreover, in at least one embodiment, additional pumping systems may be added. In one or more embodiments, the configuration shown in FIG. 3 may enable easier access to the ESPs 322, for example, by enabling bypass of the system such that the pumping unit 300 can be retrieved and then evaluated. Such a configuration provides easier access than traditional placement of ESPs 322 within the wellbore, which may lead to expensive intervention operations for recovery. Additionally, the current configuration shows components within a horizontal configuration such that a flow axis at those components is substantially parallel to the sea floor 136. It should be appreciated that such a configuration may enable simplified building and support operations, which also providing easier access the various components, but it should be appreciated that alternative configurations may also be utilized within the scope of the present disclosure, such as vertical or angled connectors, tubulars, pumps, and the like.

Embodiments of the present disclosure may utilize ESPs, but external to the well, to enable improved interventional operations while also enabling better access to the ESPs, for example, during maintenance. Accordingly, access may be provided without production shutdown, compared to operations where the ESPs are placed within the well. For example, one or more valves may be moved to a closed position such that the pumping unit 300 can be accessed without affecting operation of the wellbore.

Various embodiments of the present disclosure include a main module or system that may be divided into one or more sub-components, such as the pumping unit 300 and the base unit 302. In operation, the base unit 302 is installed prior to installation of the pumping unit 300. In this example, the production line 314 is coupled to the subsea connector 312, which is in the horizontal configuration in this example. Such a configuration may provide various benefits, such as easing access by personnel or ROVs as well as reducing bends or changes in direction due to the configuration of the tubulars 320. It should be appreciated that various embodiments may modify this positioning based on operating conditions or specifications.

The pumping unit 300 may be lowered or sunk to the base unit 302, for example via cables and/or ROVs. Each of the pumping unit 300 and/or the base unit 302 may include one or more components to facilitate landing and/or coupling of the components, as will be described herein. By way of example, the posts 306 may be used to direct the pumping unit 300 to the recess 304, and various features of the pumping unit 300, such as a positioning support, may facilitate the connection. After coupling the units together, various valves may be moved into desired positions to permit fluid flow, where the production fluid flow coming from the well passes through the system 204 gaining energy in the form of pressure increase, making its way to the surface facilitated. As a result, an increase of hydrocarbons volume produced is realized compared with a well in a similar condition without the aid of this disclosure.

Figure 4A:
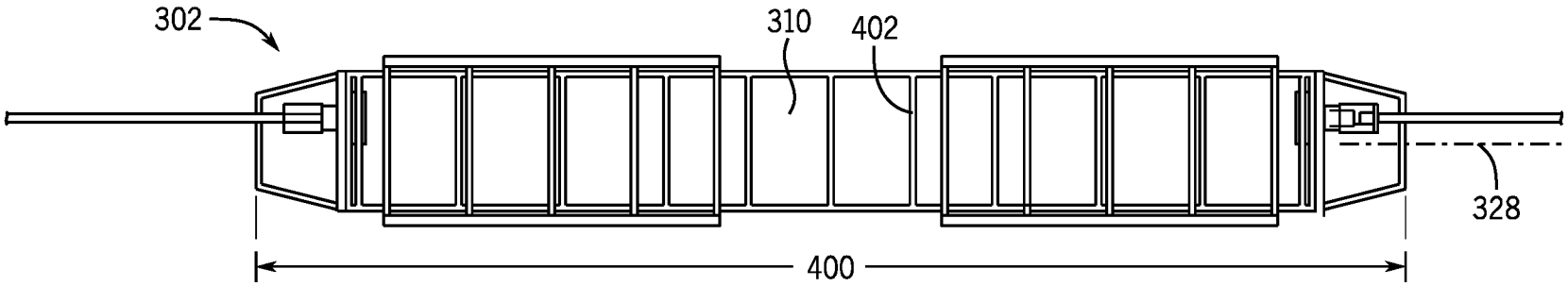
FIG. 4A is a top plan view of an embodiment of a base unit, in accordance with embodiments of the present disclosure.
Figure 4B:
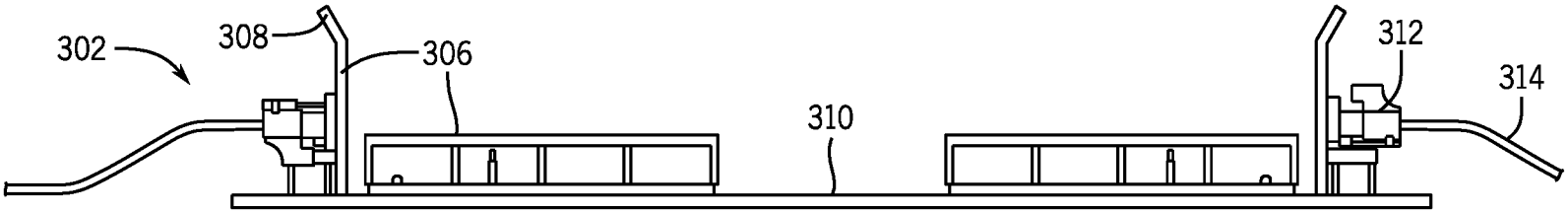
FIG. 4B is a side elevational view of an embodiment of a base unit, in accordance with embodiments of the present disclosure.
Figure 4C:
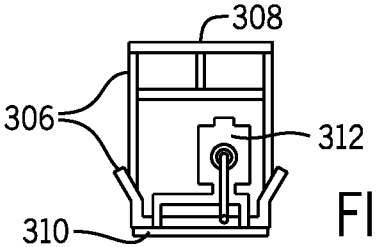
FIG. 4C is a front view of an embodiment of a pumping unit, in accordance with embodiments of the present disclosure.

FIGS. 4A-4C illustrate top, side elevational, and front views of the pumping unit 300. FIG. 4A is a top view of an embodiment of the base unit 302, FIG. 4B is a side elevation view of an embodiment of the base unit 302, and FIG. 4C illustrates a front elevational view of an embodiment of the base unit 302. As illustrated, the bottom portion 310 extends for a length 400, which may be any reasonable size depending on expected operating conditions. Furthermore, supports or reinforcements 402 are arranged along the length 400, which may be particularly selected based on the expected operating conditions, for example the pressure associated with subsea environments. The posts 306 are illustrated along each side of the bottom portion 310, with each including the slanted upper ends 308 to direct or otherwise facilitate landing of the pumping unit 300. Furthermore, the subsea connectors 312 are positioned at opposite ends of the length 400 to receive the production flow lines 314. It should be appreciated that various dimensions of the base unit 302 are particularly selected for operations, for example, to accommodate anticipated operating conditions or footprint limitations. In one or more embodiments, dimensions are adjusted to reduce an overall size and footprint, thereby enabling smaller vessels and equipment for installation operations.

While not shown in FIGS. 4A and 4B, but as described below, in one or more embodiments a bypass flow line may be included and associated with the base unit 302. For example, the bypass flow line may include a tubular extending along the length 400 and coupled to the subsea connectors 312, where one or more valves may permit or block flow through the bypass. The bypass may enable flow even when the pumping unit 300 is removed, as shown here. The bypass flow line may extend along one or more of the posts 306 and/or may include separate support structures. However, as will be described below, various embodiments may remove the bypass flow line from the base unit 302 and incorporate a bypass cap.

Figure 5A:
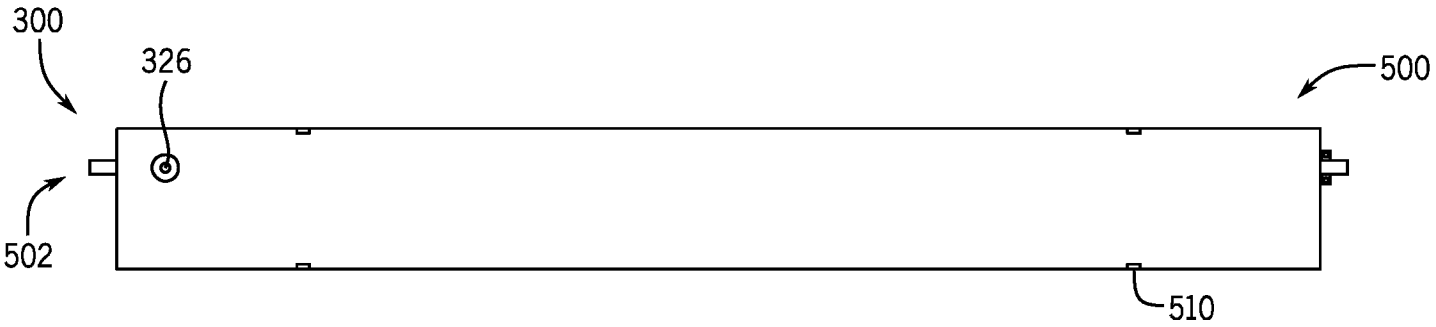
FIG. 5A is a top plan view of an embodiment of a pumping unit, in accordance with embodiments of the present disclosure.
Figure 5B:
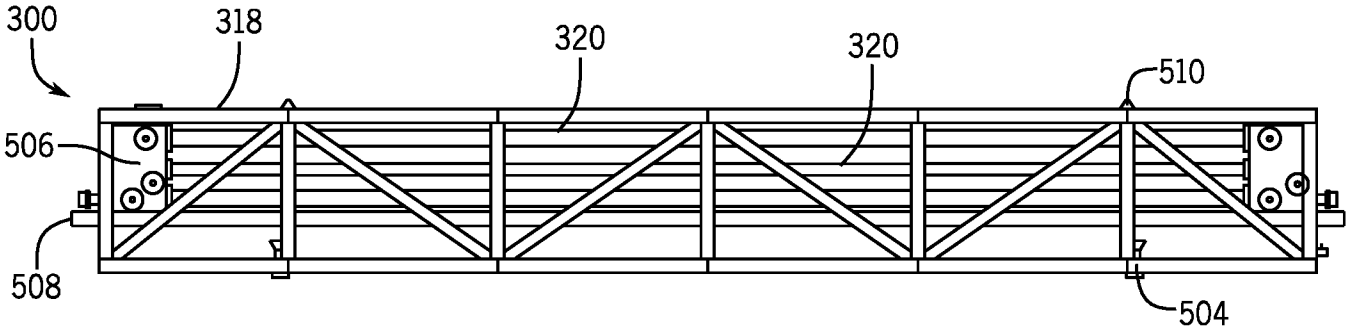
FIG. 5B is a side elevational view of an embodiment of a pumping unit, in accordance with embodiments of the present disclosure.
Figure 5C:
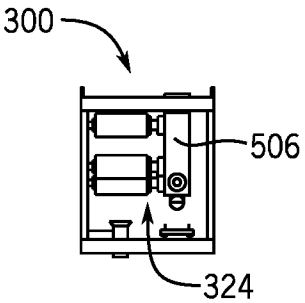
FIG. 5C is a front view of an embodiment of a pumping unit, in accordance with embodiments of the present disclosure.

FIGS. 5A-5C illustrate top, side elevational, and front views of the pumping unit 300. In this example, the frame portion 318 is illustrated as protecting and surrounding the tubulars 320 extending between a first end 500 and a second end 502. The illustrated frame portion 318 also includes landing guides 504 at the bottom, which may interact with the posts 306 of the base unit 302 to position the pumping unit 300. For example, in at least one embodiment, the landing guides 504 may engage the sloped upper portions 308 of the poste 306, thereby directing the pumping unit 300 toward the receptacle 304. In at least one embodiment, the landing guides 504 may be formed from tubulars (e.g., circular, rectangular, etc.) that are configured to receive and other accommodate pressure and/or forces due to engagement with the base unit 302. In at least one embodiment, the landing guides 504 may extend axially lower than one or more frame components, however, in other embodiments, the landing guides 504 may be flush with the lowest frame components. As noted above, in at least one embodiment, a number of cross beams and frame elements may vary based on various design conditions, among other options.

The illustrated pumping unit 300 further includes deployment features 510, which in this embodiment include eyelets or mounting members that may receive one or more cables in order to raise and/or lower the pumping unit 300 into position. Any reasonable number of deployment features 510 may be utilized and the four illustrated herein are for illustrative purposes only.

In this example, the sets of valves 324 are arranged at the first and second ends 500, 502 and one or more of the tubulars 320 may include one or more ESPs 322 arranged within the tubular 320. In various embodiments, flow controllers 506 (e.g., valve blocks) are positioned at the ends 500, 502 and may include the valves 324. The flow controllers 506 may provide a centralized location for the valves 324, which may be associated with an electronic control system for controlling a valve position. Furthermore, grouping the valves 324 together may enable easier access by an ROV.

The illustrated embodiment includes 3 tubulars 320, but it should be appreciated that more or fewer may be included. Furthermore, a bypass line 508, which is also a tubular, is illustrated with the pumping unit 300. It should be appreciated that this may be the same or different bypass described above. For example, in one embodiment the bypass line 508 may be associated with the pumping unit 300, while in another embodiment the bypass line may be associated with the base unit 302. Furthermore, as noted above, various embodiments may also include a bypass cap. It should be appreciated that each component may also have a distinct and separate bypass line. That is, the pumping 300 may include a bypass line and the base unit 302 may include a bypass line. In operation, the flow controllers 506 may be coupled to the subsea connectors 312 to regulate flow through the pumping unit 300, where different configurations may permit or block flow to different tubulars and/or ESPs to adjust the operating mode of the pumping unit 300. While the illustrated embodiment includes singular valves 324, it should be appreciated that there may be multiple valves 324 arranged in series to provide double blocking capabilities and or provide redundancy.

It should be appreciated that additional systems and methods may be included, such as one or more heat exchangers and/or injection points coupled in the pumping unit 300 and/or the base unit 302. These systems may be used to avoid hydrates and/or paraffin blockage. By way of example, one or more heat changers may be positioned at inlet or outlet points, or be incorporated into the tubulars 302. Furthermore, it should be appreciated that alternative configurations may be used, such as installing the horizontal mechanical connections as associated with the pumping unit 30. Moreover, various valves shown as being associated with the base unit 302 may also be incorporated into the flow controller 506.

Figure 6A:
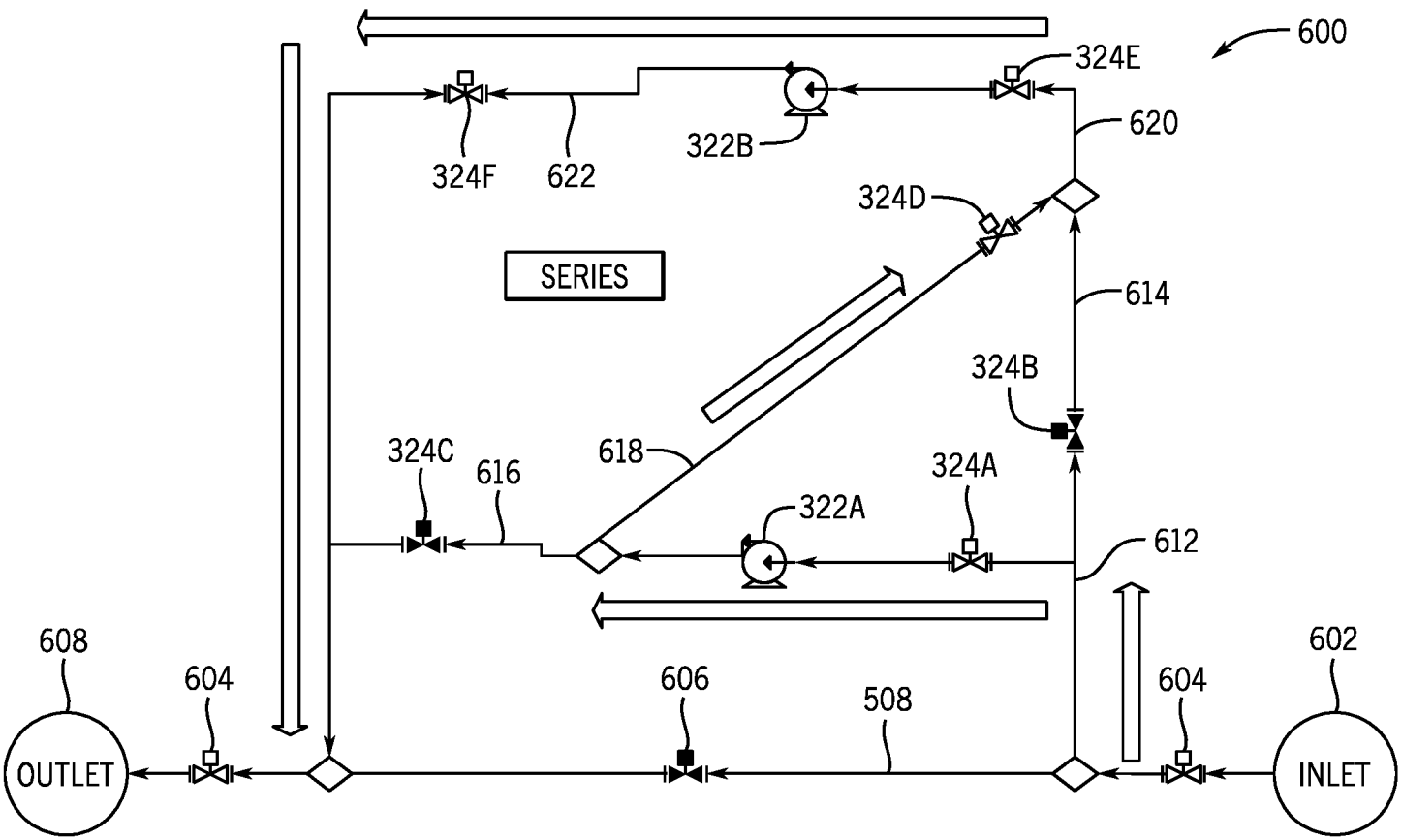
FIG. 6A is a schematic diagram of an embodiment of a valve and piping configuration, in accordance with embodiments of the present disclosure.
Figure 6B:
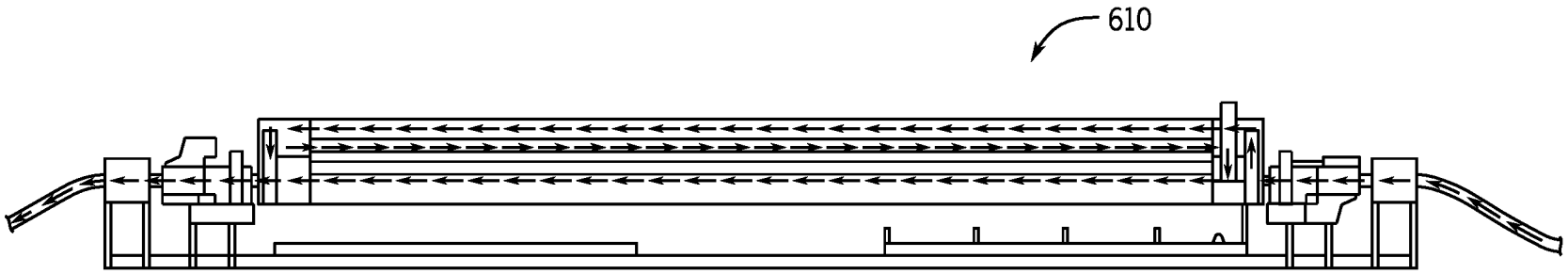
FIG. 6B is a schematic diagram of an embodiment of a flow configuration, in accordance with embodiments of the present disclosure.

FIGS. 6A and 6B illustrate a series configuration 600 to enable operation of two ESPs 322 in series. It should be appreciated that two ESPs 322 are provided by way of example only, and that other configurations may have more or fewer ESPs 322. In this example, valves 324 are illustrated as either open (not filled in) or closed (filled in). It should be appreciated that certain valves may be designed by a letter for ease of explanation.

Turning to the schematic diagram of FIG. 6A, an inlet 602 is shown, which may correspond to a coupling to the subsea connector 312. The inlet 602 directs flow to a first isolation valve 604, which may be a valve utilized to isolate or permit flow to the pumping unit 300 as a whole. For example, during installation, the isolation valves 604 may be closed and then opened to permit flow to the pumping unit 300. Singular isolation valves 604 are shown as an example, and as noted above, may include multiple valves to provide double block capabilities and redundancy. In this example, various connectors are illustrated as diamonds, with solid arrows illustrating potential flow paths and larger, non-filled arrows showing the flow path for the series configuration 600. In this example, the bypass line 508 may be blocked via a bypass valve 606.

The illustrated flow configuration includes the valves 324, 604, 606 in the configuration shown in Table 1 to permit series flow. As a result, fluid may travel through the valves 324A, 324D, 324E, 324F, 604, through the ESPs 322A, 322B, and exit the outlet 608. FIG. 6B illustrates a schematic diagram having a flow path 610 illustrating flow through the pumping unit 300 while in the series configuration.

TABLE 1

Valve Configuration for Series Flow

| Valve | Position |
|---|---|
| 324A | Open |
| 324B | Closed |
| 324C | Closed |
| 324D | Open |
| 324E | Open |
| 324F | Open |
| 604 | Open |
| 606 | Closed |

Returning to FIG. 6A, in various embodiments, different flow lines or paths along the schematic diagram may be referred to as inlets or bypasses. By way of example only, an inlet flow line 612 for the first ESP 322A may be considered as including the valve 324A and being upstream of the first ESP 322A (e.g., relative to the direction of flow of the fluid in into the pumping unit 300). A first ESP bypass line 614 may include the valve 324B. A discharge of the first ESP 616 may include the valve 324C and be considered as downstream of the first ESP 322A. A discharge line coupling to the bypass 618 may include the valve 324D and be considered downstream of the first ESP 322A. An inlet flow line 620 for the second ESP 322B may include the valve 324E and be considered upstream of the second ESP 322B and downstream of the first ESP 322A. A discharge line of the second ESP 622 may include the valve 324F and be considered downstream of the second ESP 322B. Such a configuration may be consistent among various configurations described herein.

Figure 7A:
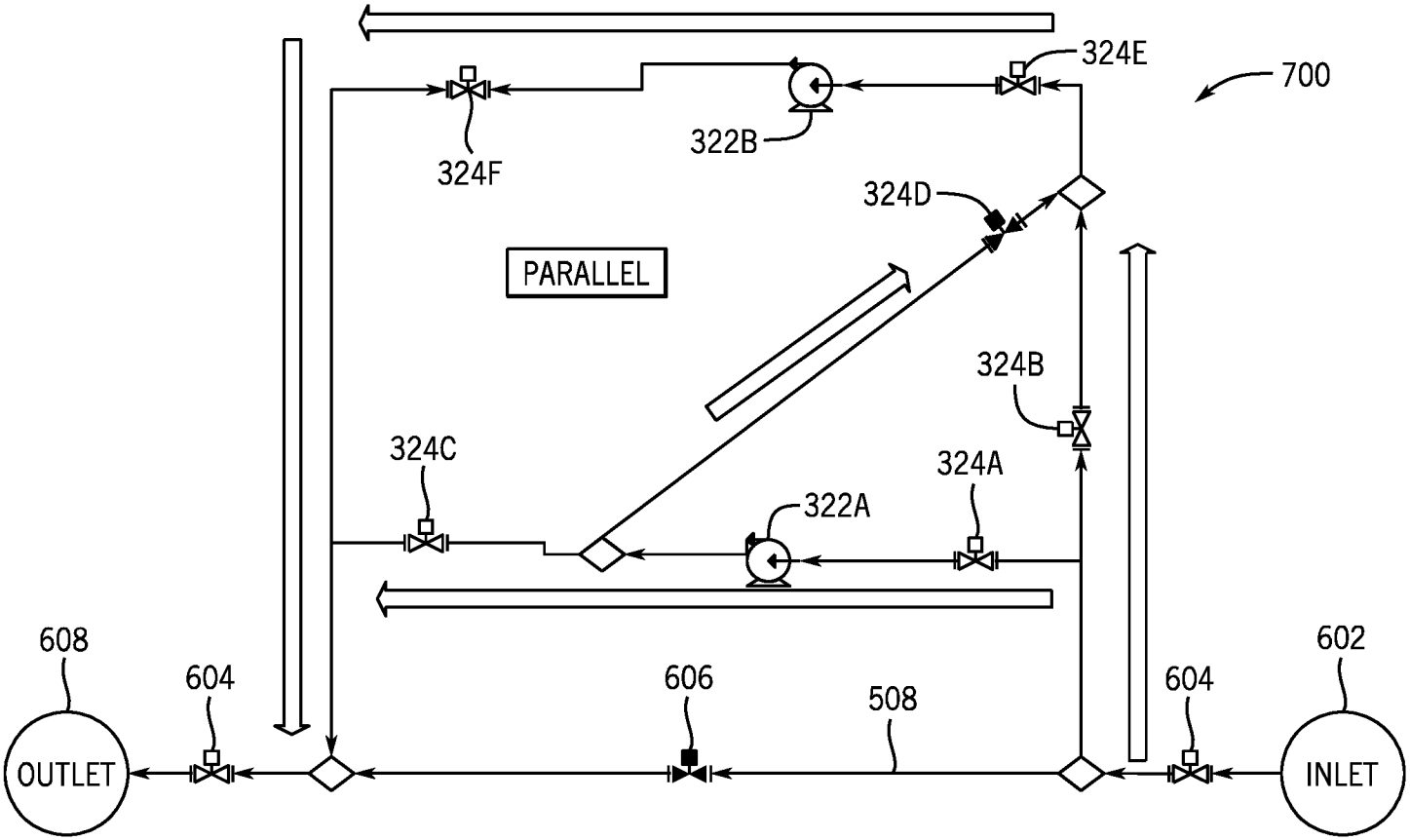
FIG. 7A is a schematic diagram of an embodiment of a valve and piping configuration, in accordance with embodiments of the present disclosure.
Figure 7B:
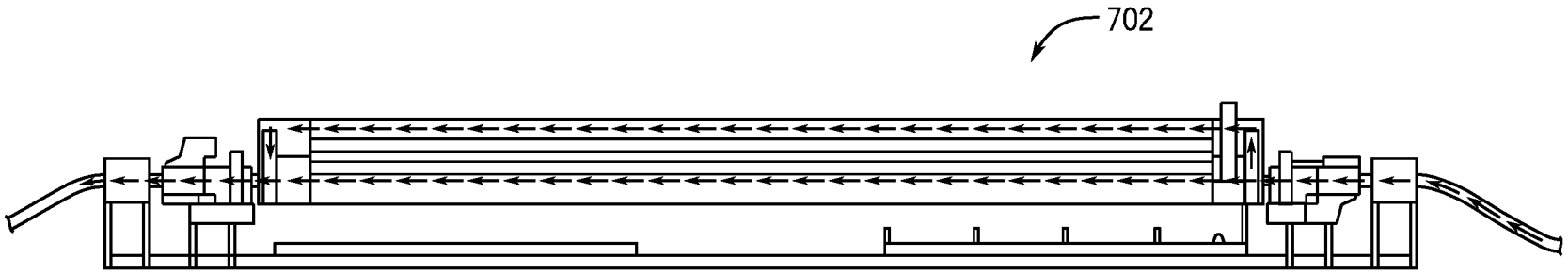
FIG. 7B is a schematic diagram of an embodiment of a flow configuration, in accordance with embodiments of the present disclosure.

FIGS. 7A and 7B illustrate a parallel configuration 700 to enable operation of two ESPs 322 in parallel. It should be appreciated that two ESPs 322 are provided by way of example only, and that other configurations may have more ESPs 322. In this example, valves 324 are illustrated as either open (not filled in) or closed (filled in). It should be appreciated that certain valves may be designed by a letter for ease of explanation.

Turning to the schematic diagram of FIG. 7A, the inlet 602 is shown, which may correspond to a coupling to the subsea connector 312. The inlet 602 directs flow to the first isolation valve 604, which may be a valve utilized to isolate or permit flow to the pumping unit 300 as a whole. As noted above, there may be additional isolation valves 604 in various embodiments. During installation, the isolation valves 604 may be closed and then opened to permit flow to the pumping unit 300. In this example, various connectors are illustrated as diamonds, with solid arrows illustrating potential flow paths and larger, non-filled arrows showing the flow path for the parallel configuration 700. In this example, the bypass line 508 may be blocked via the bypass valve 606.

The illustrated flow configuration includes the valves 324, 604, 606 in the configuration shown in Table 2 to permit parallel flow. As a result, fluid may travel through the valves 324A, 324B, 324C, 324E, 324F, 604, through the ESPs 322A, 322B, and exit the outlet 608. FIG. 7B illustrates a schematic diagram having a flow path 702 illustrating flow through the pumping unit 300 while in the parallel configuration.

TABLE 2

Valve Configuration for Parallel Flow

| Valve | Position |
|---|---|
| 324A | Open |
| 324B | Open |
| 324C | Open |
| 324D | Closed |
| 324E | Open |
| 324F | Open |
| 604 | Open |
| 606 | Closed |

Figure 8A:
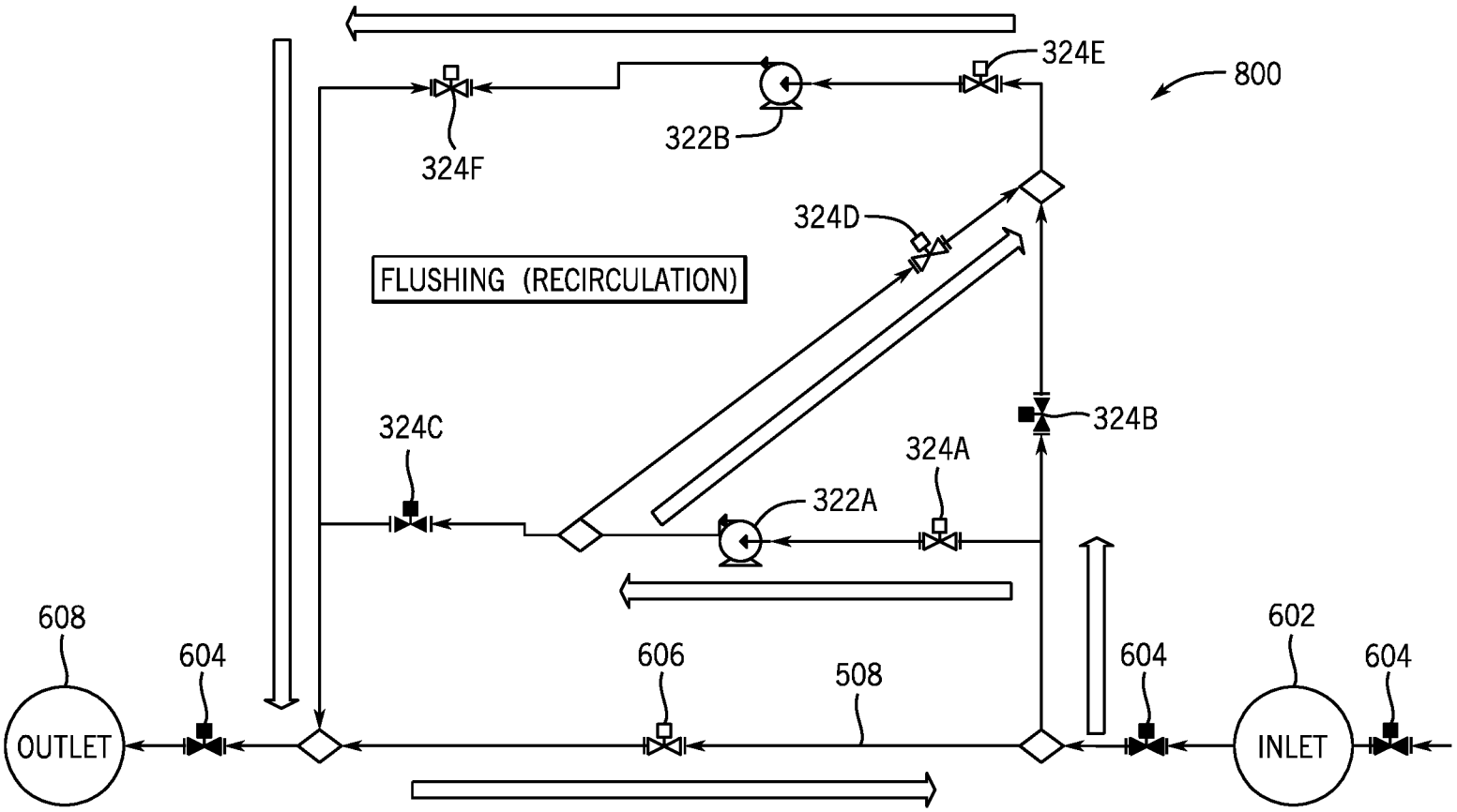
FIG. 8A is a schematic diagram of an embodiment of a valve and piping configuration, in accordance with embodiments of the present disclosure.
Figure 8B:
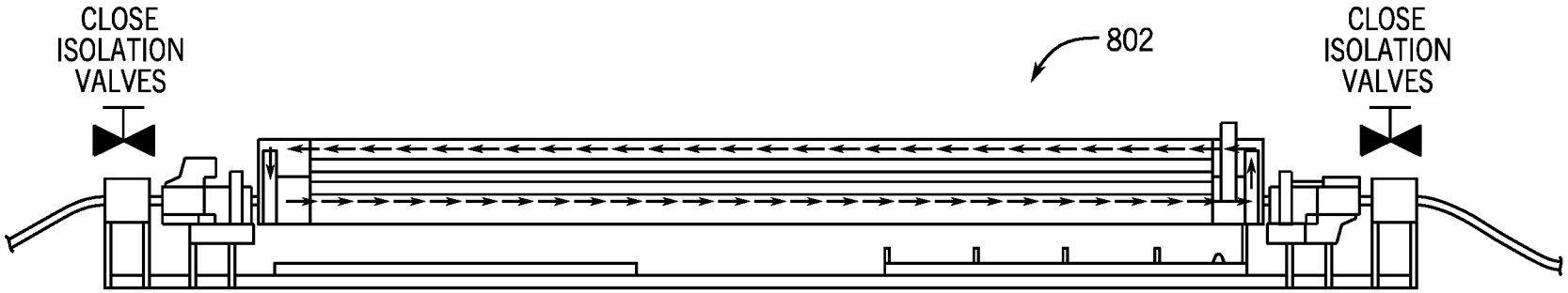
FIG. 8B is a schematic diagram of an embodiment of a flow configuration, in accordance with embodiments of the present disclosure.

FIGS. 8A and 8B illustrate a re-circulation configuration 800 to enable operation of the pumping unit 300 in a circulation mode that does not draw in additional external fluids. It should be appreciated that two ESPs 322 are provided by way of example only, and that other configurations may have more or fewer ESPs 322. In this example, valves 324 are illustrated as either open (not filled in) or closed (filled in). It should be appreciated that certain valves may be designed by a letter for ease of explanation.

Turning to the schematic diagram of FIG. 8A, the inlet 602 is shown, which may correspond to a coupling to the subsea connector 312. The inlet 602 directs flow to the first isolation valve 604, which may be a valve utilized to isolate or permit flow to the pumping unit 300 as a whole. As noted above, there may be additional isolation valves 604 in various embodiments, for example, as shown herein with the additional isolation valve 604 being on an opposite side of the inlet 602. It should be appreciated that both isolation valves 604 may be on the same side of the inlet 602. During installation, the isolation valves 604 may be closed and then opened to permit flow to the pumping unit 300. In this example, various connectors are illustrated as diamonds, with solid arrows illustrating potential flow paths and larger, non-filled arrows showing the flow path for the configuration 800. In this example, the bypass line 508 is open via the bypass valve 606.

The illustrated flow configuration includes the valves 324, 604, 606 in the configuration shown in Table 3 to permit re-circulation flow. As a result, fluid may travel through the valves 324A, 324D, 324E, 324F, 606 for recirculation or to flush out the pumping unit 300. FIG. 8B illustrates a schematic diagram having a flow path 802 illustrating flow through the pumping unit 300 while in the re-circulation configuration.

TABLE 3

Valve Configuration for Re-circulation

| Valve | Position |
|---|---|
| 324A | Open |
| 324B | Closed |
| 324C | Closed |
| 324D | Open |
| 324E | Open |
| 324F | Open |
| 604 | Closed |
| 606 | Open |

Figure 9A:
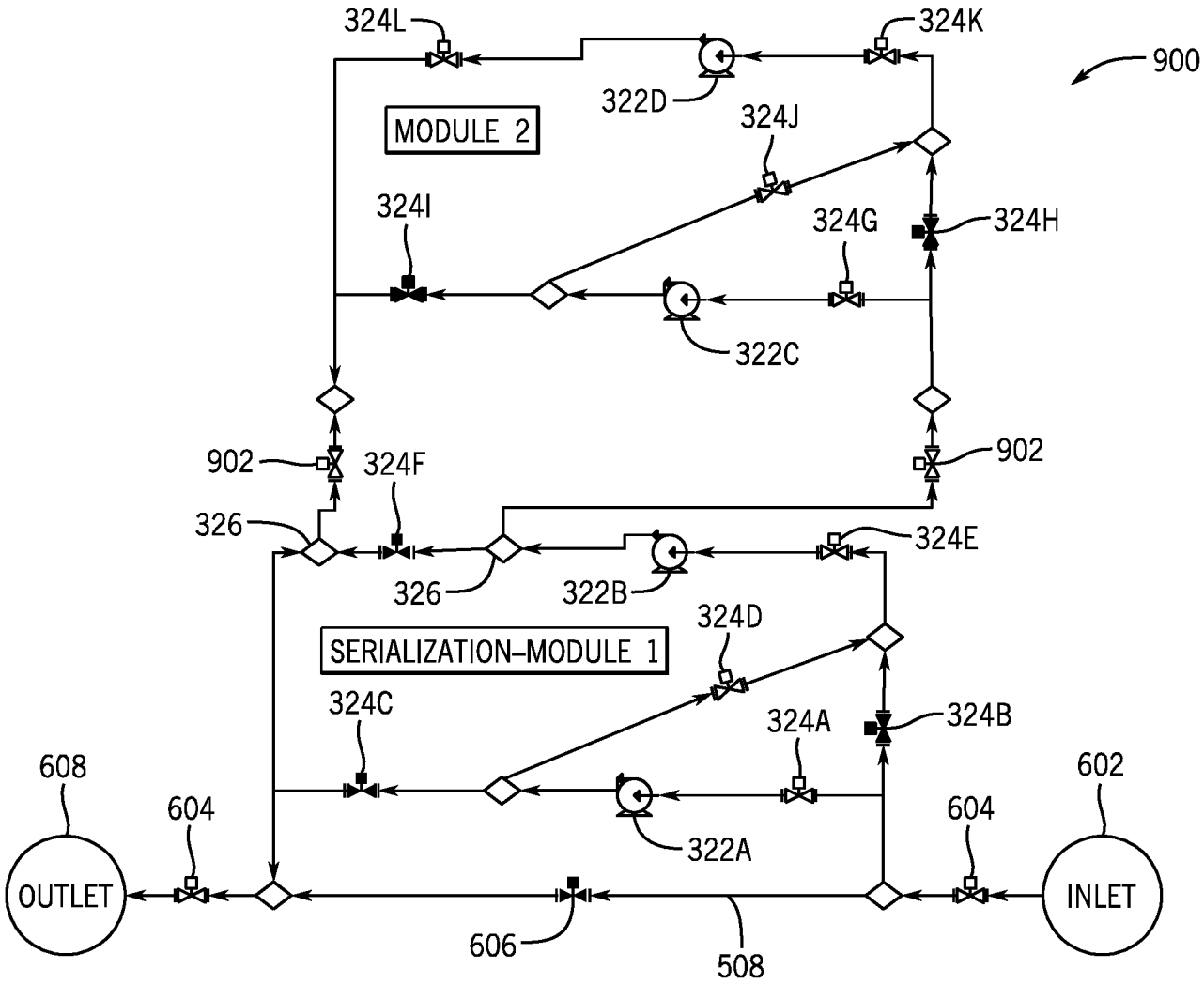
FIG. 9A is a schematic diagram of an embodiment of a valve and piping configuration, in accordance with embodiments of the present disclosure.
Figure 9B:
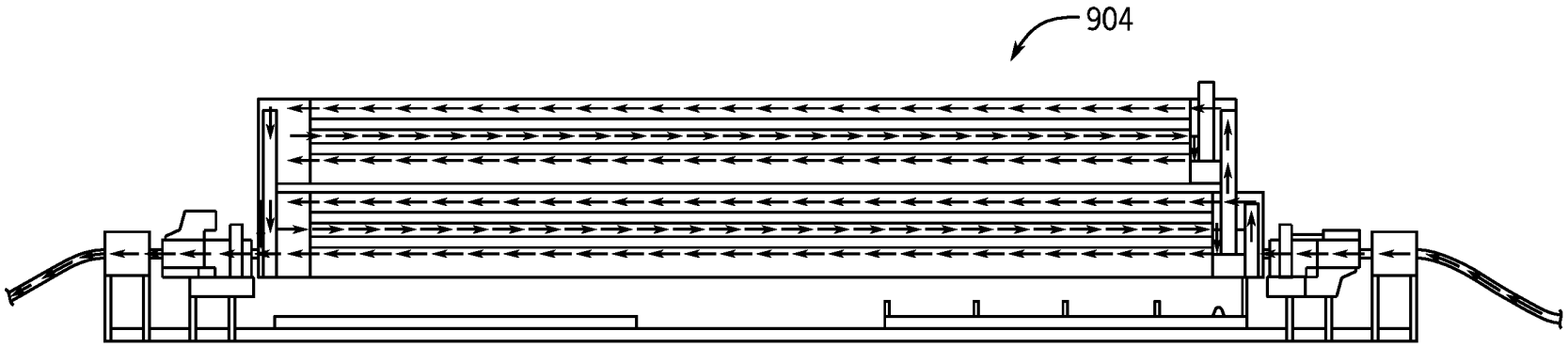
FIG. 9B is a schematic diagram of an embodiment of a flow configuration, in accordance with embodiments of the present disclosure.

FIGS. 9A and 9B illustrate a serialization configuration 900 to enable operation of a pair of pumping units 300 in a serialization mode where each of the pumps is in series. It should be appreciated that four ESPs 322 are provided by way of example only, and that other configurations may have more or fewer ESPs 322. In this example, valves 324 are illustrated as either open (not filled in) or closed (filled in). It should be appreciated that certain valves may be designed by a letter for ease of explanation.

Turning to the schematic diagram of FIG. 9A, the inlet 602 is shown, which may correspond to a coupling to the subsea connector 312. The inlet 602 directs flow to the first isolation valve 604, which may be a valve utilized to isolate or permit flow to the pumping unit 300 as a whole. As noted above, there may be additional isolation valves 604 in various embodiments. During installation, the isolation valves 604 may be closed and then opened to permit flow to the pumping unit 300. In this example, various connectors are illustrated as diamonds, with solid arrows illustrating potential flow paths. In this example, the bypass line 508 is closed via the bypass valve 606.

Different from the other configurations shown herein, the serialization connections 326 are utilized to add an additional pumping unit 300. In this example, additional serialization valves 902 permit flow and also facilitate return flow. It should also be appreciated that this configuration may also be used during re-circulation, as illustrated by the arrows.

The illustrated flow configuration includes the valves 324, 604, 606, 902 in the configuration shown in Table 4 to permit serialized flow. As a result, fluid may travel through the valves 324A, 324D, 324E, 324G, 324J, 324K, 324L, 902, 604, 606, through the ESPs 322A, 322B, 322C, 322D, and exit the outlet 608. FIG. 9B illustrates a schematic diagram having a flow path 904 illustrating flow through the pumping units 300 while in the serialized configuration.

TABLE 4

Valve Configuration for Serialized Flow

| Valve | Position |
|---|---|
| 324A | Open |
| 324B | Closed |
| 324C | Closed |
| 324D | Open |
| 324E | Open |
| 324F | Closed |
| 324G | Open |
| 324H | Closed |
| 324I | Closed |
| 324J | Open |

TABLE 4-continued

| Valve Configuration for Serialized Flow | |
|---|---|
| Valve | Position |
| 324K | Open |
| 324L | Open |
| 902 | Open |
| 604 | Open |
| 606 | Open |

Figure 10:
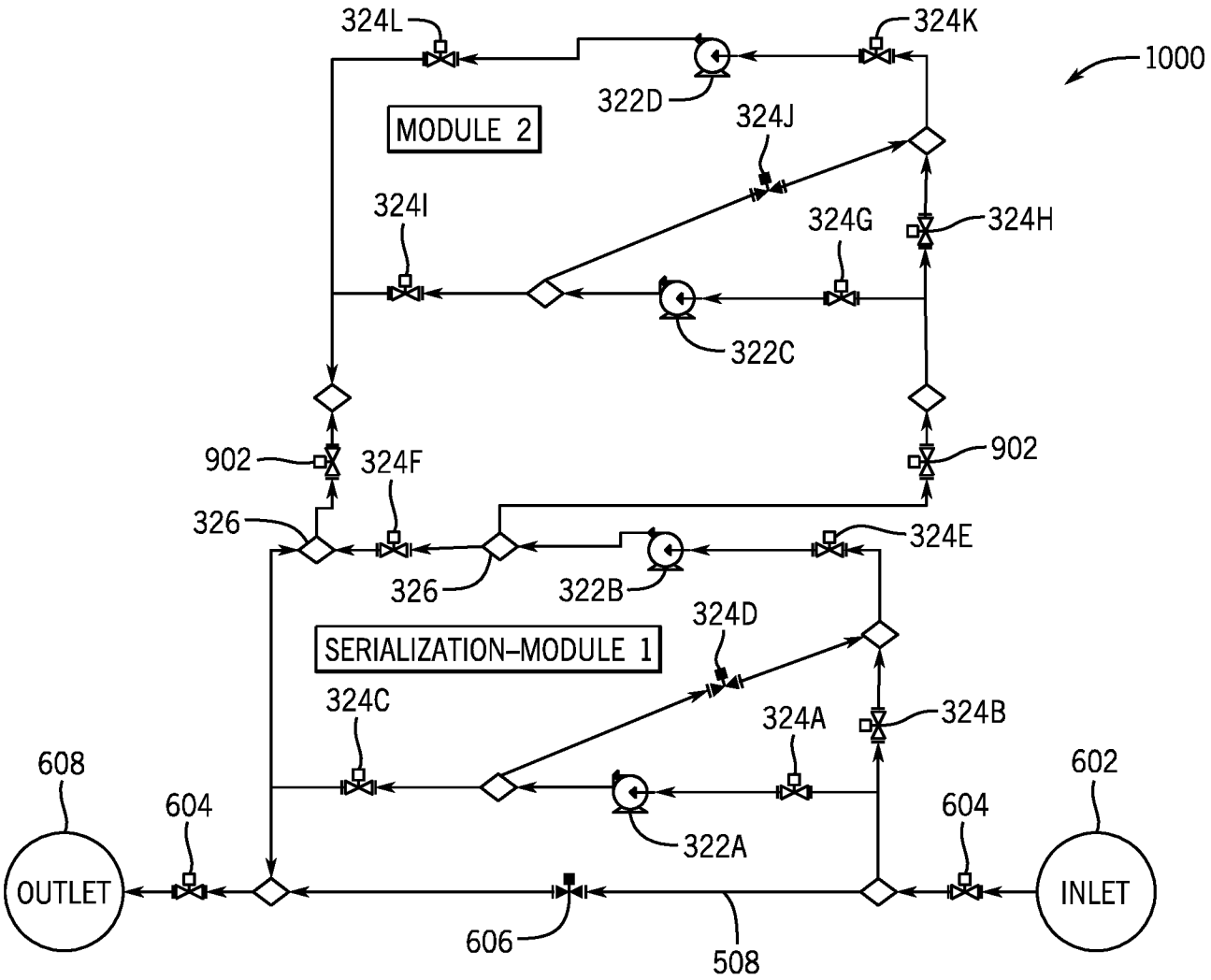
FIG. 10 is a schematic diagram of an embodiment of a valve and piping configuration, in accordance with embodiments of the present disclosure.

FIG. 10 illustrates a serialization configuration 1000 to enable operation of a pair of pumping units 300 in a serialization mode where the pumping units 300 are in parallel. It should be appreciated that four ESPs 322 are provided by way of example only, and that other configurations may have more or fewer ESPs 322. In this example, valves 324 are illustrated as either open (not filled in) or closed (filled in). It should be appreciated that certain valves may be designed by a letter for ease of explanation.

Turning to the schematic diagram of FIG. 10, the inlet 602 is shown, which may correspond to a coupling to the subsea connector 312. The inlet 602 directs flow to the first isolation valve 604, which may be a valve utilized to isolate or permit flow to the pumping unit 300 as a whole. As noted above, there may be additional isolation valves 604 in various embodiments. During installation, the isolation valves 604 may be closed and then opened to permit flow to the pumping unit 300. In this example, various connectors are illustrated as diamonds, with solid arrows illustrating potential flow paths. In this example, the bypass line 508 is closed via the bypass valve 606.

In this example, the serialization connections 326 are utilized to add an additional pumping unit 300. Moreover, additional serialization valves 902 permit flow and then also facilitate return flow. It should also be appreciated that this configuration may also be used during re-circulation, as illustrated by the arrows.

The illustrated flow configuration includes the valves 324, 604, 606, 902 in the configuration shown in Table 5 to permit serialized flow with pumps in a parallel configuration.

TABLE 5

| Valve Configuration for Serialized Flow | |
|---|---|
| Valve | Position |
| 324A | Open |
| 324B | Open |
| 324C | Open |
| 324D | Closed |
| 324E | Open |
| 324F | Open |
| 324G | Open |
| 324H | Open |
| 324I | Open |
| 324J | Closed |
| 324K | Open |
| 324L | Open |
| 902 | Open |
| 604 | Open |
| 606 | Open |

Figure 11A:
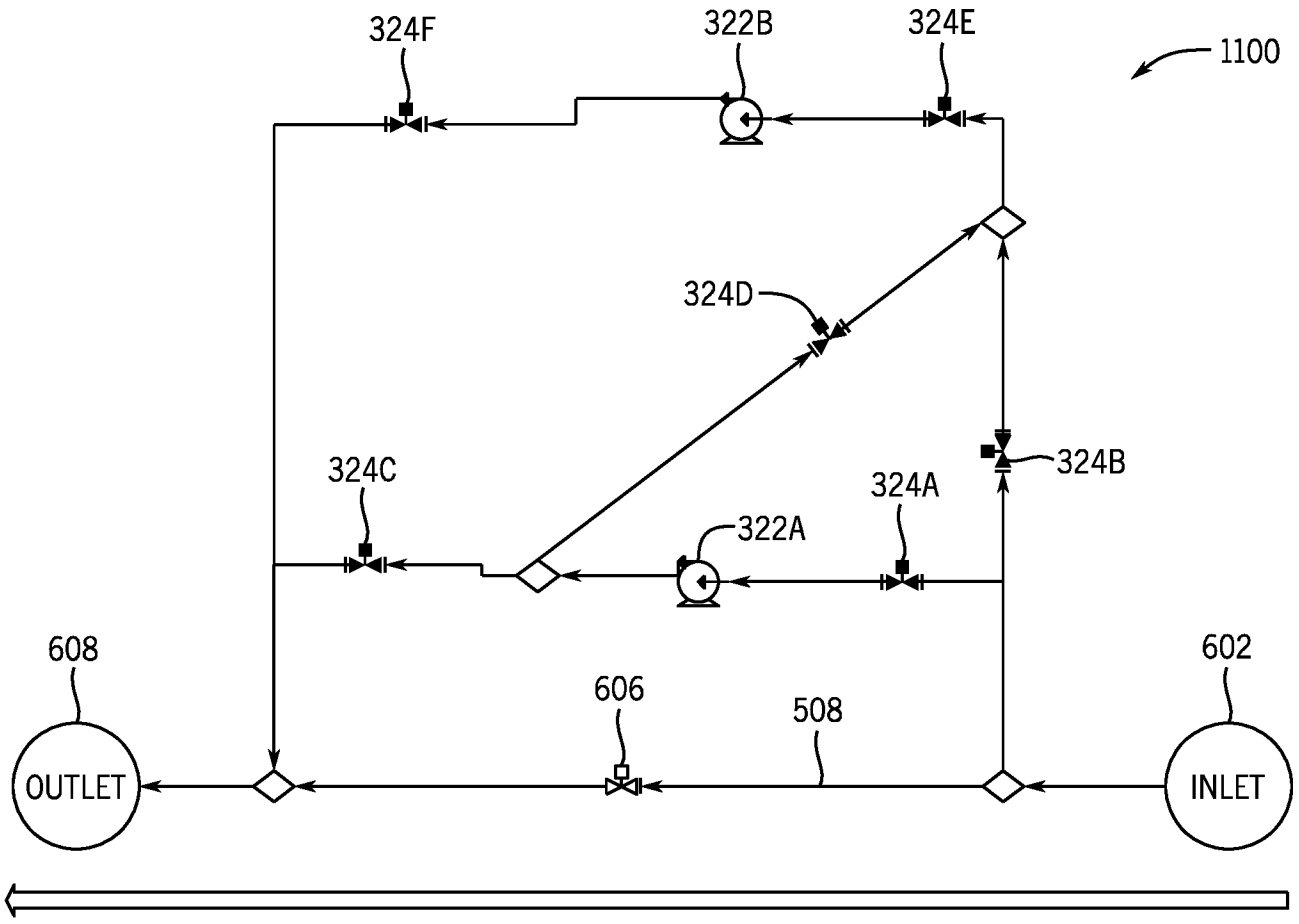
FIG. 11A is a schematic diagram of an embodiment of a flow configuration, in accordance with embodiments of the present disclosure.
Figure 11B:
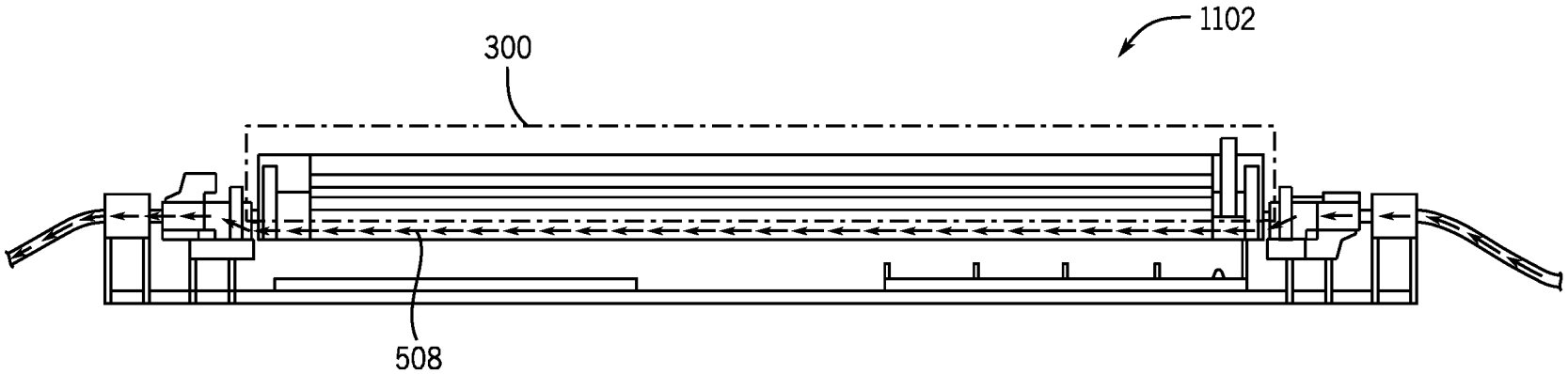
FIG. 11B is a schematic diagram of an embodiment of a flow configuration, in accordance with embodiments of the present disclosure.

FIGS. 11A and 11B illustrate a bypass flow configuration 1100. As noted above, the bypass may be through the bypass line 508 or through an independent bypass incorporated into the base unit 302, but in this configuration the bypass line 508 forms a portion of the pumping unit 300. In examples where the bypass line 508 is part of the base unit 302, the pumping unit 300 may be removed while flow continues through the bypass line. Moreover, in various embodiments, bypass may be accomplished through a bypass cap.

Turning to the schematic diagram of FIG. 11A, the inlet 602 is shown, which may correspond to a coupling to the subsea connector 312. The inlet 602 directs flow through the bypass 508 in this example. It should be appreciated that the isolation valves 604 are removed in this configuration, but other configurations may include the isolation valves 604. In this example, various connectors are illustrated as diamonds, with solid arrows illustrating potential flow paths and larger, non-filled arrows showing the flow path for the configuration 1100. In this example, the bypass line 508 is open via the bypass valve 606.

The illustrated flow configuration includes the valves 324, 606 in the configuration shown in Table 6 to permit bypass flow. FIG. 11B illustrates a schematic diagram having a flow path 1102 illustrating flow through the pumping unit 300 while in the bypass configuration.

TABLE 6

| Valve Configuration for Bypass | |
|---|---|
| Valve | Position |
| 324A | Closed |
| 324B | Closed |
| 324C | Closed |
| 324D | Closed |
| 324E | Closed |
| 324F | Closed |
| 606 | Open |

Figure 12A:
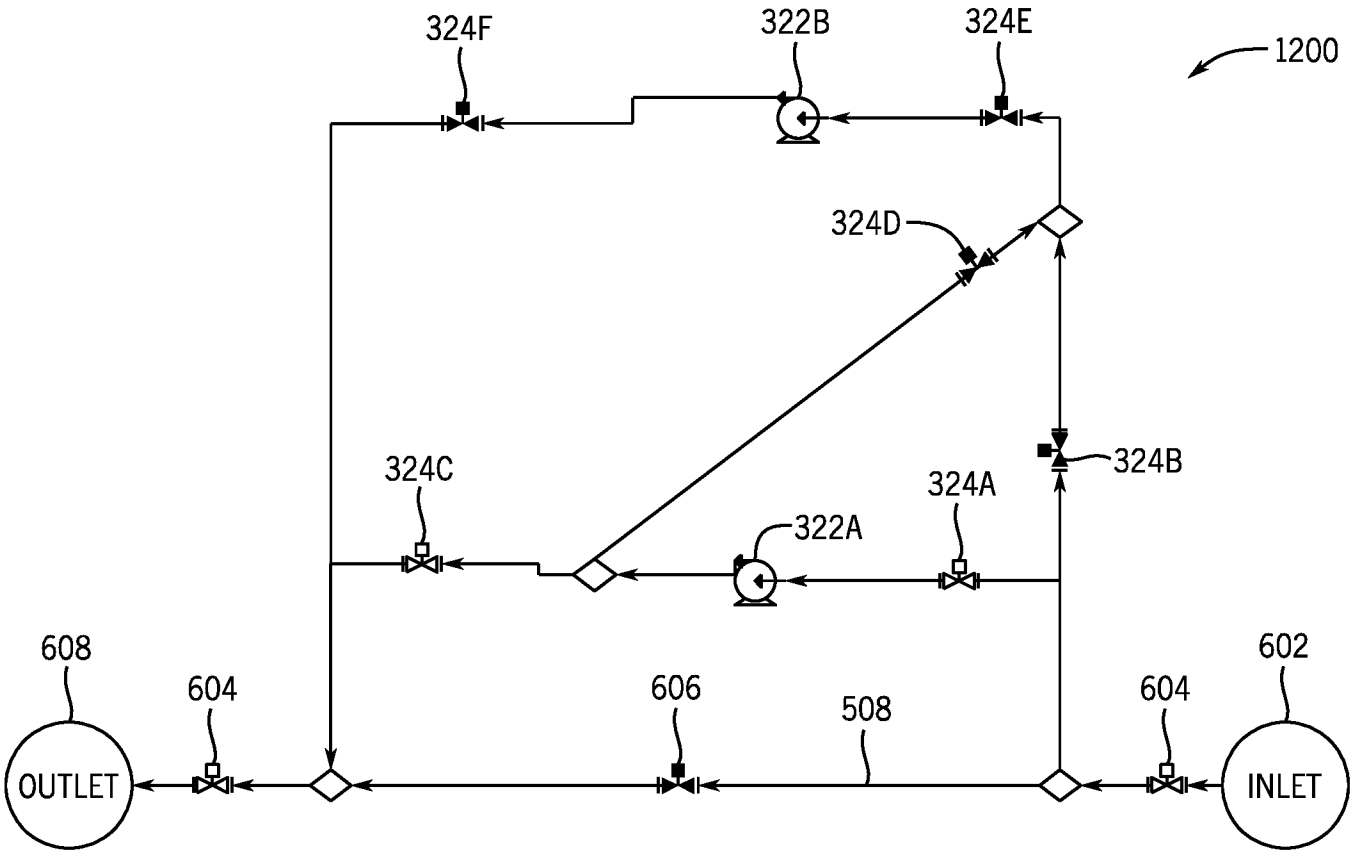
FIG. 12A is a schematic diagram of an embodiment of a valve and piping configuration, in accordance with embodiments of the present disclosure.
Figure 12B:
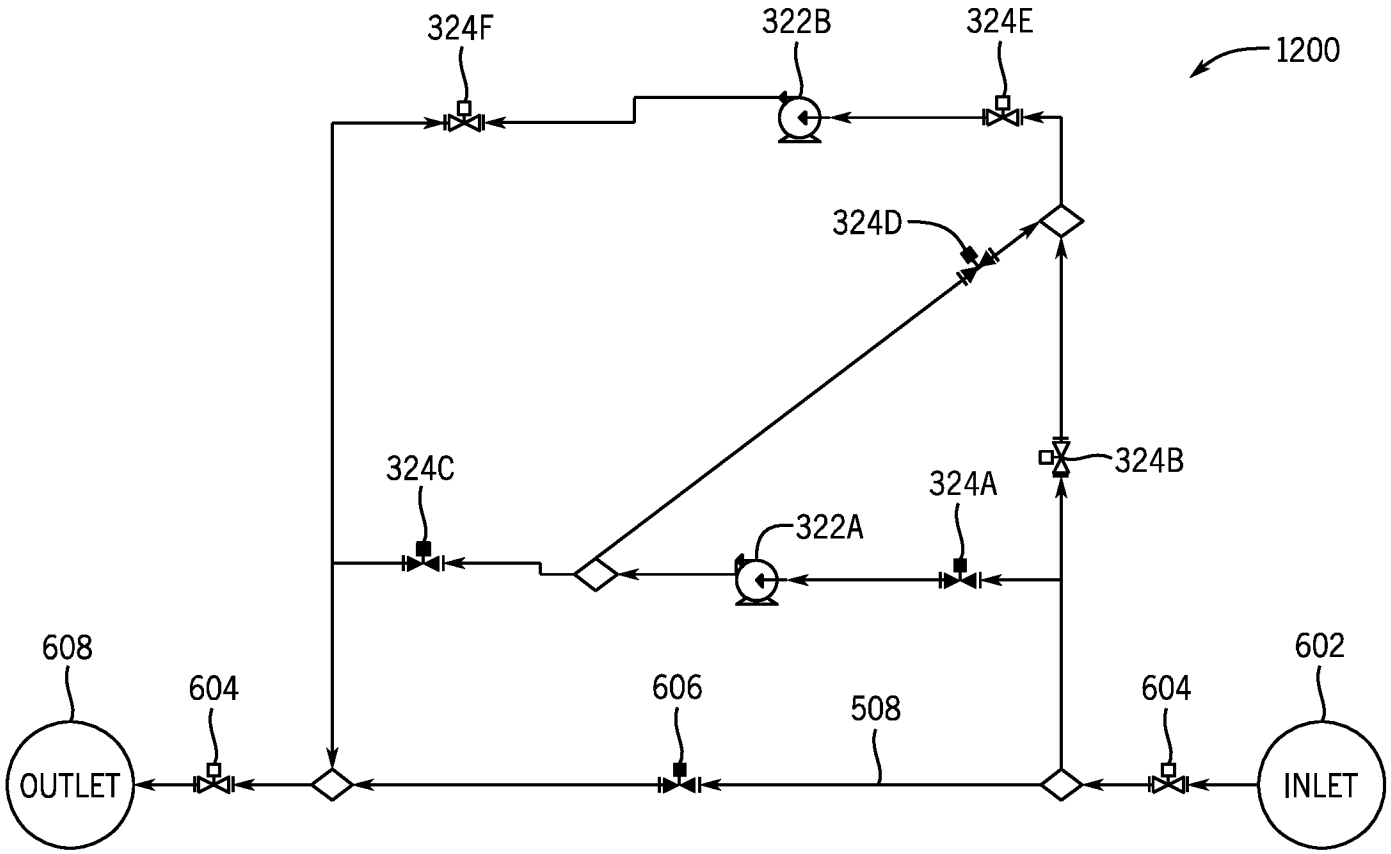
FIG. 12B is a schematic diagram of an embodiment of a valve and piping configuration, in accordance with embodiments of the present disclosure.

FIGS. 12A and 12B illustrate a series configuration 1200 to enable operation of two ESPs 322 at different times, where a first ESP may be a primary ESP and a second ESP may be a secondary or back up ESP. It should be appreciated that two ESPs 322 are provided by way of example only, and that other configurations may have more ESPs 322. In this example, valves 324 are illustrated as either open (not filled in) or closed (filled in). It should be appreciated that certain valves may be designed by a letter for ease of explanation.

Turning to the schematic diagram of FIG. 12A, an inlet 602 is shown, which may correspond to a coupling to the subsea connector 312. The inlet 602 directs flow to a first isolation valve 604, which may be a valve utilized to isolate or permit flow to the pumping unit 300 as a whole. For example, during installation, the isolation valves 604 may be closed and then opened to permit flow to the pumping unit 300. Singular isolation valves 604 are shown as an example, and as noted above, may include multiple valves to provide double block capabilities and redundancy. In this example, various connectors are illustrated as diamonds, with solid arrows illustrating potential flow paths and larger, non-filled arrows showing the flow path for the series configuration 600. In this example, the bypass line 508 may be blocked via a bypass valve 606.

The illustrated flow configuration includes the valves 324, 604, 606 in the configuration shown in Table 7 to permit flow of a single ESP while maintaining an ESP as a backup and/or for redundancy. As a result, fluid may travel through the valves 324A, 324C, 604, through the ESP 322A and exit the outlet 608. However, in this configuration, the ESP 322B may not be operational and/or may be maintained for later operation

TABLE 7

| Valve Configuration for Single Flow | |
|---|---|
| Valve | Position |
| 324A | Open |
| 324B | Closed |
| 324C | Open |
| 324D | Closed |
| 324E | Closed |
| 324F | Closed |
| 604 | Open |
| 606 | Closed |

Turning to the schematic diagram of FIG. 12B, an inlet 602 is shown, which may correspond to a coupling to the subsea connector 312. The inlet 602 directs flow to a first isolation valve 604, which may be a valve utilized to isolate or permit flow to the pumping unit 300 as a whole. For example, during installation, the isolation valves 604 may be closed and then opened to permit flow to the pumping unit 300. Singular isolation valves 604 are shown as an example, and as noted above, may include multiple valves to provide double block capabilities and redundancy. In this example, various connectors are illustrated as diamonds, with solid arrows illustrating potential flow paths and larger, non-filled arrows showing the flow path for the series configuration 600. In this example, the bypass line 508 may be blocked via a bypass valve 606.

The illustrated flow configuration includes the valves 324, 604, 606 in the configuration shown in Table 8 to permit flow of a single ESP while maintaining an ESP as a backup and/or for redundancy. As a result, fluid may travel through the valves 324B, 324E, 324F, 604, through the ESP 322B and exit the outlet 608. However, in this configuration, the ESP 322A may not be operational and/or may be maintained for later operation

TABLE 8

| Valve Configuration for Single Flow | |
|---|---|
| Valve | Position |
| 324A | Closed |
| 324B | Open |
| 324C | Closed |
| 324D | Closed |
| 324E | Open |
| 324F | Open |
| 604 | Open |
| 606 | Closed |

Figure 13A:
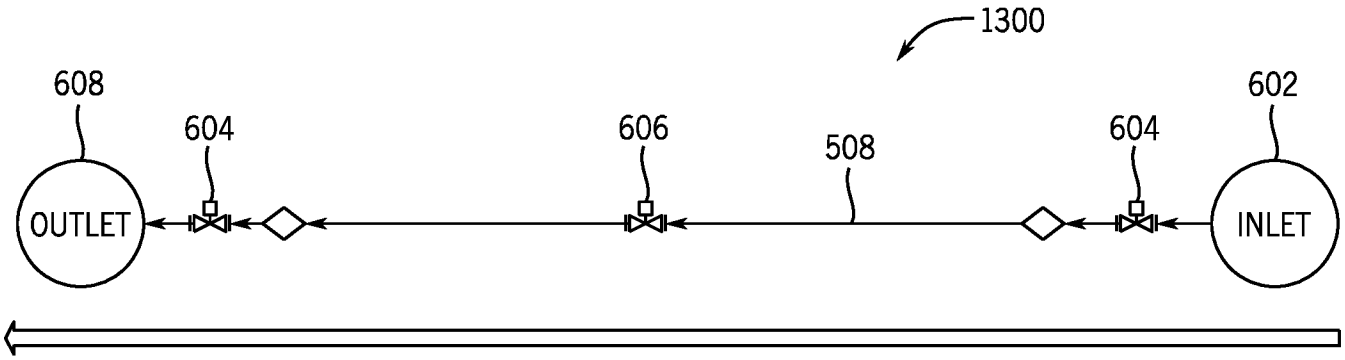
FIG. 13A is a schematic diagram of an embodiment of a valve and piping configuration, in accordance with embodiments of the present disclosure.
Figure 13B:
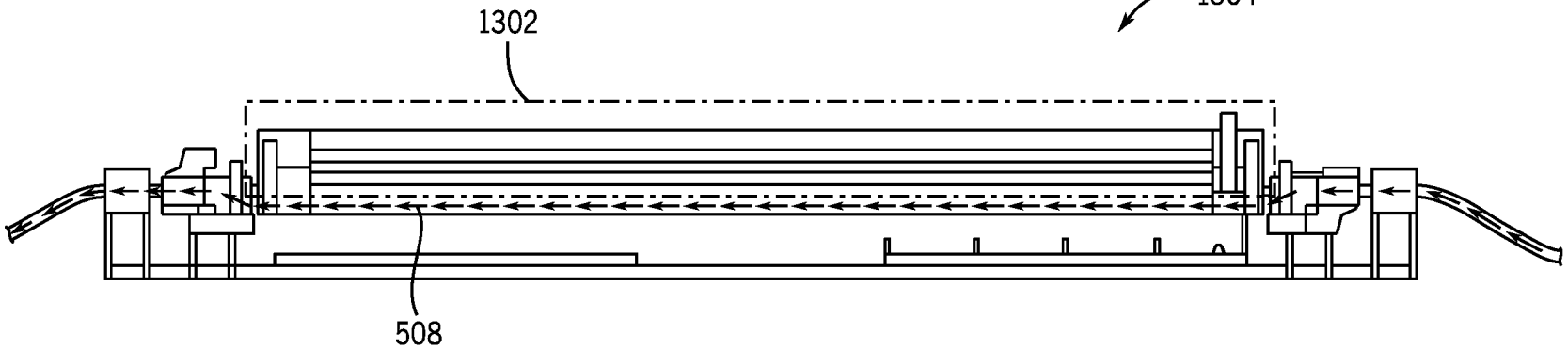
FIG. 13B is a schematic diagram of an embodiment of a flow configuration, in accordance with embodiments of the present disclosure.

FIGS. 13A and 13B illustrate a bypass flow configuration 1300 that includes a bypass cap 1302. As noted above, the bypass may be through the bypass line 508 or through an independent bypass incorporated into the base unit 302, but in this configuration the bypass line 508 forms a portion of the bypass cap 1302. In various embodiments, the bypass cap 1302 may be positioned on the base unit 302 during operations that do not utilize a booster system and removed when a pumping unit 302 is installed. Alternatively, one or more pumping units may be positioned in a serialized configuration with the bypass cap 1302.

Turning to the schematic diagram of FIG. 13A, the inlet 602 is shown, which may correspond to a coupling to the subsea connector 312. The inlet 602 directs flow through the bypass 508 in this example. The isolation valves 604 are also open to permit flow through the bypass 508. In this example, various connectors are illustrated as diamonds, with solid arrows illustrating potential flow paths and larger, non-filled arrows showing the flow path for the configuration 1300. In this example, the bypass line 508 is open via the bypass valve 606.

The illustrated flow configuration includes the valve 606 in the configuration shown in Table 9 to permit bypass flow. FIG. 13B illustrates a schematic diagram having a flow path 1304 illustrating flow through the bypass cap 1302 while in the bypass configuration.

TABLE 9

| Valve Configuration for Bypass | |
|---|---|
| Valve | Position |
| 606 | Open |

It should be appreciated that various components, such as support systems, electrical systems, control systems, injection systems, and the like may also be incorporated into the embodiments described herein. By way of example only, one or more injection systems may be utilized to enable chemical or other injection into the pumping system 204. For example, the injection system may be upstream and/or downstream of one or more ESPs 322 and may include a separate pump or the like to provide sufficient pressure to enter the system. In one or more embodiments, the injection systems may include an injection point that extends into the tubulars 320 and/or at various other locations associated with the system, for example at the subsea connectors 312 and/or at various other locations. In various embodiments, chemical and/or fluid injection may assist in the flow assurance and improve lifting performance. Examples of issues to be treated are hydrate, paraffin's, emulsion, and scale, among others. Additionally, systems may also utilize one or more heat exchangers in order to control or assist with flow. For example, one or more heater systems may include heat exchangers or other heaters to control a system temperature, which may facilitate flow. Moreover, in one or more embodiments, the ESPs 322 themselves may be used as heating elements.

Various embodiments may be described with reference to operation of two or more EPSs 322, but it should be appreciated that one or more ESPs 322 may operate independently and/or without the use of the other ESPs 322 within the system. As an example, one ESP 322 may be taken offline for maintenance while the other ESP 322 continues to run. Furthermore, in various embodiments, lifting requirements may permit operation of only a single ESP 322 within the system.

As noted above, various support systems and the like have not been shown for convenience. One such example includes various block valves, drains, vents, and the like. For example, one or more drains (e.g., low point drains) may be provided to facilitate clearing or otherwise flushing of the system before and/or after the system is placed into use. In one example, at the surface, the drains and/or vents may be used to clear the system prior to installation. Furthermore, the system may be drained, either subsea or at the surface, prior to or after retrieval. Drains may be utilized for removal or liquid and/or gases. Additionally, these systems, or other support systems, may enable pressure compensation during subsea deployment and/or retrieval.

It should be appreciated that various control and monitoring systems may also be associated with embodiments of the present disclosure, either as a separately deployable skid, integrated system, surface system, or a combination thereof. For example, instrumentation may be incorporated to enable ESP performance monitoring, such as monitoring a speed, pressure, flow rate, and/or the like. Moreover, individual ESP current measurement may be incorporated by direct and/or indirect methodologies. System monitoring may be incorporated with one or more motors utilized to drive the ESPs 322, which may be any suitable type of motor, such as induction or permanent magnet motors, among other options. Accordingly, systems and methods may be provided to monitor operation of the ESPs 322. In certain embodiments, these systems may provide control of the system to facilitate operation at approximately 1200 rpm. Additionally, the system may facilitate operation up to 10,000 rpms. These operational ranges of the ESPs should be understood as example ranges and are not intended to limit the scope of the present disclosure.

The foregoing disclosure and description of the disclosed embodiments is illustrative and explanatory of the embodiments of the disclosure. Various changes in the details of the illustrated embodiments can be made within the scope of the appended claims without departing from the true spirit of the disclosure. The embodiments of the present disclosure should only be limited by the following claims and their legal equivalents.

The invention claimed is:

1. A system, comprising:

a pumping unit, the pumping unit comprising:

a plurality of tubulars, the plurality of tubulars directing flow from a first end to a second end;

two or more electric submersible pumps (ESPs) positioned within at least two or more tubulars of the plurality of tubulars, the two or more ESPs receiving production fluid and increasing a pressure of the production fluid;

a frame supporting and surrounding at least a portion of the at least two or more tubulars of the plurality of tubulars associated with the two or more ESPs; and a plurality of valves associated with the plurality of tubulars, the plurality of valves each independently moveable between respective open positions and closed positions, wherein respective positions of groups of valves correspond to operational configurations selected to adjust operation of the two or more ESPs; and a base unit, adapted to receive the pumping unit, the base unit being positioned at a subsea location and extending, along an axis of the base unit that is parallel to at least one axis of the plurality of tubulars, for a length that is longer than the pumping unit to support the pumping unit, the base unit comprising:

a subsea connector, arranged in a horizontal configuration parallel to the axis of the base unit and at least the two or more tubulars of the plurality of tubulars associated with the two or more ESPs, for receiving a production line and directing the production fluid toward the pumping unit; and an isolation valve, upstream of the subsea connector, to block the production fluid.

2. The system of claim 1, further comprising:

a post formed on the base unit, the post directing the pumping unit toward a receptacle during installation of the pumping unit; and landing guides formed on the frame of the pumping unit, the landing guides supporting the pumping unit on the base unit.

3. The system of claim 1, further comprising:

a bypass associated with the pumping unit.

4. The system of claim 1, further comprising:

a serialization connector associated with the pumping unit, the serialization connector providing at least one of an inlet or an outlet for a second pumping unit.

5. The system of claim 1, wherein at least one operational configuration is a series operation, the series operation having a valve configuration corresponding to:

a first valve, upstream of a first ESP of the two or more ESPs, and along an inlet flow line for the first ESP, in an open position;

a second valve, upstream of the first ESP and along a first ESP bypass line, in a closed position;

a third valve, downstream of the first ESP and along a discharge line of the first ESP, in a closed position;

a fourth valve, downstream of the first ESP and along the discharge line coupling to the first ESP bypass line, in an open position;

a fifth valve, downstream of the first ESP and upstream of a second ESP of the two or more ESPs, and along a flow line directed toward the second ESP, in an open position; and a sixth valve, downstream of the second ESP along a discharge line of the second ESP, in an open position.

6. The system of claim 1, wherein at least one operational configuration is a parallel operation, the parallel operation having a valve configuration corresponding to:

a first valve, upstream of a first ESP of the two or more ESPs, and along an inlet flow line of the first ESP, in an open position;

a second valve, upstream of the first ESP and along a first ESP bypass line, in an open position;

a third valve, downstream of the first ESP and along a first discharge line of the first ESP, in an open position;

a fourth valve, downstream of the first ESP and along a second discharge line coupling to the first ESP bypass line, in a closed position;

a fifth valve, downstream of the first ESP and upstream of a second ESP of the two or more ESPs, and along a flow line directed toward the second ESP, in an open position; and a sixth valve, downstream of the second ESP along a discharge line of the second ESP, in an open position.

7. The system of claim 1, wherein at least one operational configuration is a re-circulation operation, the re-circulation operation having a valve configuration corresponding to:

an inlet isolation valve, in a closed position;

an outlet isolation valve, in a closed position;

a first valve, upstream of a first ESP of the two or more ESPs, and along an inlet flow line of the first ESP, in an open position;

a second valve, upstream of the first ESP and along a first ESP bypass line, in a closed position;

a third valve, downstream of the first ESP and along a first discharge line of the first ESP, in a closed position;

a fourth valve, downstream of the first ESP and along a second discharge line coupling to the first ESP bypass line, in an open position;

a fifth valve, downstream of the first ESP and upstream of a second ESP of the two or more ESPs, and along a flow line directed toward the second ESP, in an open position;

a sixth valve, downstream of the second ESP along a discharge line of the second ESP, in an open position; and a seventh valve, positioned along a bypass line between the inlet isolation valve and the outlet isolation valve, the bypass line being coupled to the discharge line of the second ESP and the inlet flow line of the first ESP, in an open position.

8. The system of claim 1, wherein the two or more ESPs are in a horizontal position.

9. The system of claim 1, further comprising:

a bypass cap, the bypass cap having an inlet isolation valve, an outlet isolation valve, and a bypass valve along a bypass flow line.

10. A system, comprising:

a pumping unit, the pumping unit comprising:

a plurality of tubulars, the plurality of tubulars directing flow from a first end to a second end;

two or more electric submersible pumps (ESPs) positioned within at least two or more tubulars of the plurality of tubulars, the two or more ESPs receiving production fluid and increasing a pressure of the production fluid;

a frame associated with at least the two or more tubulars of the plurality of tubulars, wherein at least the two or more tubulars of the plurality of tubulars are at least partially within a perimeter of the frame; and a plurality of valves associated with the plurality of tubulars, the plurality of valves each independently moveable between respective open positions and closed positions, wherein respective positions of groups of valves correspond to operational configurations selected to adjust operation of the two or more ESPs; and a base unit, comprising:

a receptacle adapted to receive the frame of the pumping unit;

one or more outwardly extending posts, forming at least a portion of the receptacle, extending outwardly away from the frame, when the frame is positioned within the receptacle, along an axis of the base unit that is aligned with at least one axis of the plurality of tubulars;

a subsea connector for receiving a production line and directing production fluid toward the pumping unit; and an isolation valve, upstream of the subsea connector, to block the production fluid.

11. The system of claim 10, further comprising:

a second subsea connector associated with an outlet line and directing boosted fluid toward a well; and a second isolation valve, downstream of the second subsea connector, to block the boosted fluid.

12. The system of claim 10, further comprising:

a second isolation valve, arranged at at least one of upstream the subsea connector or downstream the subsea connector, the second isolation valve providing a double block configuration for the production fluid.

13. The system of claim 10, further comprising:

a second pumping unit, the second pumping unit comprising:

a second plurality of tubulars, the second plurality of tubulars directing flow from a second pumping unit first end to a second pumping unit second end; and two or more second ESPs positioned within at least two or more second tubulars of the second plurality of tubulars, the two or more second ESPs receiving the production fluid and increasing the pressure of the production fluid.

14. The system of claim 13, wherein the second pumping unit is stacked on the pumping unit, a flow path between the second pumping unit and the pumping unit being formed, at least in part, by one or more serialization connectors.

15. The system of claim 10, wherein at least one operational configuration is a standby operation, the standby operation having a valve configuration corresponding to:

a first valve, upstream of a first ESP of the two or more ESPs, and along an inlet flow line for the first ESP, in an open position;

a second valve, upstream of the first ESP and along a first ESP bypass line, in a closed position;

a third valve, downstream of the first ESP and along a first discharge line of the first ESP, in an open position;

a fourth valve, downstream of the first ESP and along a second discharge line coupling to the first ESP bypass line, in a closed position;

a fifth valve, downstream of the first ESP and upstream of a second ESP of the two or more ESPs, and along a flow line directed toward the second ESP, in a closed position; and a sixth valve, downstream of the second ESP along a discharge line of the second ESP, in a closed position;

wherein the second ESP of the two or more ESPs is non-operational in the standby operation.

16. The system of claim 10, wherein at least one operational configuration is a standby operation, the standby operation having a valve configuration corresponding to:

a first valve, upstream of a first ESP of the two or more ESPs, and along an inlet flow line for the first ESP, in a closed position;

a second valve, upstream of the first ESP and along a first ESP bypass line, in an open position;

a third valve, downstream of the first ESP and along a first discharge line of the first ESP, in a closed position;

a fourth valve, downstream of the first ESP and along a second discharge line coupling to the first ESP bypass line, in a closed position;

a fifth valve, downstream of the first ESP and upstream of a second ESP of the two or more ESPs, and along a flow line directed toward the second ESP, in an open position; and a sixth valve, downstream of the second ESP along a discharge line of the second ESP, in an open position;

wherein the first ESP of the two or more ESPs is non-operational in the standby operation.

17. A system, comprising:

a pumping unit, the pumping unit comprising:

a plurality of tubulars, the plurality of tubulars directing flow from a first end to a second end;

two or more electric submersible pumps (ESPs) positioned within at least one tubular of the plurality of tubulars, the two or more ESPs receiving fluid and increasing a pressure of the fluid;

a support structure for the plurality of tubulars; and a plurality of valves associated with the plurality of tubulars, the plurality of valves each independently moveable between respective open positions and closed positions, wherein a plurality of valve configurations correspond to a plurality of operational modes for the two or more ESPs; and a base unit, comprising:

a receptacle adapted to receive the pumping unit;

sets of posts arranged at ends of the receptacle, wherein each post of each set of posts includes a sloped upper post portion, the sloped upper post portion being outwardly sloped, away from the receptacle, along an axis of the base unit that is aligned with at least one axis of the plurality of tubulars;

a connector for receiving a fluid line; and an isolation valve, upstream of the connector.

18. The system of claim 17, further comprising:

a second connector for associated with an outlet line and coupled to a well; and a second isolation valve, downstream of the second connector.

19. The system of claim 17, further comprising:

a second pumping unit, the second pumping unit comprising:

a second plurality of tubulars, the second plurality of tubulars directing flow from a second pumping unit first end to a second pumping unit second end; and two or more second ESPs positioned within at least two or more second tubulars of the second plurality of tubulars, the two or more second ESPs receiving the fluid and increasing the pressure of the fluid.

20. The system of claim 19, wherein the second pumping unit is stacked on the pumping unit, a flow path between the second pumping unit and the pumping unit being formed, at least in part, by one or more serialization connectors.

* * * * *